US012281833B2

(12) United States Patent
Bae et al.

(10) Patent No.: US 12,281,833 B2
(45) Date of Patent: Apr. 22, 2025

(54) REFRIGERATOR

(71) Applicant: LG Electronics Inc., Seoul (KR)

(72) Inventors: Daham Bae, Seoul (KR); Daekil Kang, Seoul (KR); Ohchul Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/541,485

(22) Filed: Dec. 15, 2023

(65) Prior Publication Data

US 2024/0118013 A1 Apr. 11, 2024

Related U.S. Application Data

(62) Division of application No. 17/368,167, filed on Jul. 6, 2021, now Pat. No. 11,885,553.

(30) Foreign Application Priority Data

Jul. 6, 2020 (KR) ..... 10-2020-0082772
Jul. 6, 2020 (KR) ..... 10-2020-0082773

(51) Int. Cl.
*F25D 11/00* (2006.01)
*F25D 1/00* (2006.01)

(52) U.S. Cl.
CPC ..... *F25D 11/00* (2013.01); *F25D 1/00* (2013.01); *F25D 2201/126* (2013.01)

(58) Field of Classification Search
None
See application file for complete search history.

(56) References Cited

U.S. PATENT DOCUMENTS 3,411,247 A * 11/1968 Fleming ..... E06B 3/26347 52/786.13
4,080,756 A * 3/1978 Heaney ..... A47F 3/043 49/492.1
4,732,432 A * 3/1988 Keil ..... F25D 23/082 220/592.06
4,891,912 A * 1/1990 Bockwinkel ..... F25D 23/082 49/478.1

(Continued)

FOREIGN PATENT DOCUMENTS

CN 107976001 5/2018
CN 108756639 11/2018

(Continued)

OTHER PUBLICATIONS

Extended European Search Report in European Appln. No. 21183731.5, dated Feb. 12, 2021, 8 pages.

*Primary Examiner* — Hanh V Tran
(74) *Attorney, Agent, or Firm* — Fish & Richardson P.C.

(57) ABSTRACT

A refrigerator includes a cabinet having a storage space and a door configured to open and close the storage space. The door includes a panel assembly including a front panel and an insulating panel spaced apart from the front panel, a door frame that is in contact with the front panel, and a door liner which is connected to the door frame and is in contact with the insulating panel, the door liner being configured to define an insulating space, in which an insulator is disposed, together with the panel assembly and the door frame. The door liner includes a contact surface that is in contact with the insulating panel, and a recessed space is defined on the contact surface.

20 Claims, 14 Drawing Sheets

(56) References Cited

U.S. PATENT DOCUMENTS

| | | | | |
|---|---|---|---|---|
| 5,636,484 | A * | 6/1997 | DeBlock | E06B 3/5892 52/204.5 |
| 5,910,083 | A * | 6/1999 | Richardson | A47F 3/0434 52/656.1 |
| 7,043,886 | B1 * | 5/2006 | Chubb | F25D 23/028 52/204.5 |
| 10,228,182 | B2 | 3/2019 | Choi et al. | |
| 11,609,038 | B2 * | 3/2023 | Kim | F25D 23/028 |
| 11,796,243 | B2 * | 10/2023 | Park | F25D 23/067 |
| 11,885,556 | B2 * | 1/2024 | Kang | F25D 27/005 |
| 2008/0024047 | A1 * | 1/2008 | Juo | F25D 23/02 312/236 |
| 2008/0190046 | A1 * | 8/2008 | Hecht | A47F 3/0434 52/173.1 |
| 2010/0061079 | A1 * | 3/2010 | Li | F21V 33/0044 362/92 |
| 2010/0154462 | A1 * | 6/2010 | Arzoz Barandalla | F25D 23/028 62/449 |
| 2016/0045038 | A1 * | 2/2016 | Chubb | A47F 3/043 428/34 |
| 2016/0220039 | A1 * | 8/2016 | Chang | G02B 6/0093 |
| 2016/0265836 | A1 * | 9/2016 | Hong | F25D 23/02 |
| 2017/0188721 | A1 * | 7/2017 | Park | F21V 23/0442 |
| 2017/0191745 | A1 * | 7/2017 | Choi | A47F 3/0434 |
| 2017/0211874 | A1 * | 7/2017 | Kim | F25D 23/025 |
| 2017/0299258 | A1 * | 10/2017 | Gong | B08B 1/00 |
| 2018/0112906 | A1 * | 4/2018 | Yi | F25D 23/02 |
| 2018/0112909 | A1 * | 4/2018 | Choi | F25D 23/02 |
| 2018/0156535 | A1 * | 6/2018 | Kim | H04R 1/028 |
| 2018/0164025 | A1 * | 6/2018 | Lv | F25D 23/02 |
| 2018/0274846 | A1 * | 9/2018 | Kim | F25D 27/005 |
| 2018/0274852 | A1 * | 9/2018 | Kang | F25D 27/005 |
| 2018/0292127 | A1 * | 10/2018 | Park | F25D 23/028 |
| 2019/0383551 | A1 * | 12/2019 | Choi | A47F 3/0434 |
| 2021/0396458 | A1 * | 12/2021 | Moon | F25D 23/028 |

FOREIGN PATENT DOCUMENTS

| | | |
|---|---|---|
| JP | S4840863 | 11/1973 |
| JP | S6453886 | 4/1989 |
| JP | H-0473580 | 3/1992 |
| JP | H-08233443 | 9/1996 |
| JP | 2016-173233 | 9/2016 |
| JP | 2019-181222 | 10/2019 |
| KR | 10-2006-0036312 | 4/2006 |
| KR | 10-2017-0019341 | 2/2017 |
| KR | 10-2017-0082095 | 7/2017 |
| WO | WO 2018043933 | 3/2018 |

* cited by examiner

REFRIGERATOR

CROSS-REFERENCE TO RELATED APPLICATIONS

This application is a divisional of U.S. application Ser. No. 17/368,167, filed on Jul. 6, 2021, which claims priority under 35 U.S.C. § 119 to Korean Patent Application No. 10-2020-0082772, filed in Korea, on Jul. 6, 2020, and Korean Patent Application No. 10-2020-0082773, filed in Korea, on Jul. 6, 2020, the entire disclosures of which are hereby incorporated by reference.

TECHNICAL FIELD

This specification relates to a refrigerator.

BACKGROUND

In general, refrigerators are home appliances for storing foods at low temperature in an inner storage space covered by a refrigerator door. Here, the inside of the storage space is cooled using cool air that is generated by being heat-exchanged with a refrigerant circulated in a refrigeration cycle to store the foods in an optimal state.

Since the storage space is sealed by the refrigerator door, the refrigerator door has to have an insulating function.

To allow the refrigerator door to have the insulating function, the refrigerator door may define an insulating space therein, and a foaming liquid injected through an injection hole is hardened to provide an insulator in the insulating space.

In some example refrigerators, a door may include a panel assembly and a frame assembly which has an opening and to which an edge of the panel assembly is connected to the opening to support panel assembly, and a foaming space is defined between the frame assembly and the panel assembly to accommodate an insulator.

A plurality of foam injection holes into which the insulator is injected are provided in a top or bottom surface of the frame assembly.

However, in these examples, the foam injection holes are defined in the top or bottom surface of the frame assembly, and the foaming liquid passing through the foam injection holes are directly introduced into the foaming space.

However, a portion of the foaming liquid that is directly introduced into the foaming space, but another of the foaming liquid is spread to the surroundings, and the other portion is hardened by colliding with surrounding structures.

Here, the hardened foaming liquid may act as resistance around the foam injection holes by colliding with the surrounding structures to reduce an injection rate of the foaming liquid, and the foaming liquid may not be uniformly distributed into the foaming space.

Also, the foaming liquid spread to the surroundings may act as resistance of the foaming liquid that is to be subsequently injected.

The frame assembly includes a rear frame disposed on a rear surface of the door and a side frame connected to the rear frame to define the foaming space. The panel assembly include a front panel, an intermediate panel, and a rear panel.

A first end of the rear frame is in contact with the rear panel, and the side frame is in contact with the front panel to define the foaming space.

The foaming liquid is injected into the space, and while the foaming liquid is hardened, the foaming liquid is expanded. However, there is a limitation that the foaming liquid leaks between the first end of the rear frame and the rear panel.

SUMMARY

Embodiments provide a refrigerator in which a foaming liquid is prevented from leaking in a state in which the foaming liquid is completely injected.

Optionally or additionally, embodiments also provide a refrigerator in which coupling force between a door liner and an insulating panel increases.

Optionally or additionally, embodiments also provide a refrigerator in which a transmission portion, through which light is capable of being transmitted, is maximized in size.

Optionally or additionally, embodiments also provide a refrigerator in which a foaming liquid is maintained in straightness even in an insulating space so as to be uniformly distributed into a refrigerator door.

Optionally or additionally, embodiments also provide a refrigerator in which an injection portion is prevented from being blocked while a foaming liquid is injected.

Optionally or additionally, embodiments also provide a refrigerator in which an inner space of an upper frame is partitioned from a foam injection portion to facilitate a service of components within the upper frame.

Particular implementations of the present disclosure provide a refrigerator that includes a cabinet defining a storage space, and a door configured to open and close the storage space. The door may include a panel assembly comprising a front panel and an insulating panel spaced apart from the front panel, a door frame that contacts the front panel, and a door liner that is connected to the door frame and contacts the insulating panel. The door liner, the panel assembly, and the door frame may define an insulating space that receives an insulator. The door liner may include a contact surface that contacts the insulating panel, and a recessed space defined at the contact surface.

In some implementations, the refrigerator can optionally include one or more of the following features. The recessed space may be recessed at the contact surface in a direction away from the insulating panel. The recessed space may continuously extend along the contact surface. The door liner may include an inner body that defines a liner opening covered by the insulating panel, the inner body contacting the contact surface. The inner body may include a first body, and a second body extending from the first body and having the contact surface and the recessed space. The second body may include (i) a first portion connected to the first body and (ii) a second portion away from the first body and defining the contact surface. The second portion may be thicker than the first portion. The second body may include an outer surface defining the liner opening, and an inner surface defining the insulating space. The contact surface may connect the outer surface to the inner surface. The outer surface of the second body and an outer surface of the first body may define a plane surface. A first angle defined by the contact surface and the outer surface of the second body may be greater than a second angle defined by the contact surface and the inner surface of the second body. The first angle may be an acute angle, and the second angle may be an obtuse angle. The recessed space may be disposed closer to the inner surface than to the outer surface. A first distance between the recessed space and the inner surface of the second body may be less than a second distance between the recessed space and the outer surface of the second body. The recessed space may have a depth less than a minimum thickness of the second body, the depth of the recessed space may be greater than a maximum width of the recessed space, or the maximum width of the recessed space may be less than a minimum distance between the recessed space and the outer surface of the second body. A distance between the inner surface and the outer surface of the second body may increase from the first body toward the insulating panel. The inner body may include an outer surface defining the liner opening, and an inner surface defining the insulating space. The contact surface may connect the outer surface to the inner surface. A first distance between the recessed space to the inner surface may be less than a second distance between the recessed space and the outer surface. The recessed space may have a depth greater than the first distance between the recessed space and the inner surface.

Particular implementations of the present disclosure provide a refrigerator that includes a cabinet defining a storage space, and a door configured to open and close the storage space. The door may include a panel assembly comprising a front panel and an insulating panel spaced apart from the front panel, a door frame connected to the panel assembly, and a door liner. The door liner, the panel assembly, and the door frame may define an insulating space that receives an insulator. The door frame may include an injection portion configured to receive a foaming liquid therethrough that forms the insulator. The injection portion may include (i) a first portion configured to guide a flow of the foaming liquid from an outside of the insulating space into the insulating space, and (ii) a second portion configured to guide a flow of the foaming liquid within the insulating space.

In some implementations, the refrigerator can optionally include one or more of the following features. The first portion of the injection portion may include a guide tube configured to enable the foaming liquid to pass through the door frame. The second portion of the injection portion may include a guide groove configured to guide the foaming liquid passing through the guide tube. The guide tube may be configured to guide the foaming liquid to flow into the insulating space in a first direction. The guide groove may be configured to guide at least a portion of the foaming liquid in the insulating space to additionally flow in the first direction. The door frame may include a front wall facing the front panel, a rear wall spaced apart from the front wall, and a connection wall connecting a lower portion of the front wall to a lower portion of the rear wall. The connection wall, the front wall, and the rear wall may define an accommodation space. The guide tube may extend from the connection wall to the accommodation space. The guide groove may be defined at a portion of the connection wall. The connection wall may include a first surface defining the accommodation space, and a second surface defining the insulating space. The guide tube may extend from the first surface. The guide groove may be defined at the second surface toward the rear wall. An upper portion of the door frame may include an opening that is covered by a frame cover coupled to the door frame. The frame cover may be configured to, based on the frame cover being coupled to the door frame, cover the guide tube.

In one embodiment, a refrigerator includes: a cabinet having a storage space; and a door configured to open and close the storage space.

The door may include: a panel assembly including a front panel and an insulating panel spaced apart from the front panel; a door frame that is in contact with the front panel; and a door liner which is connected to the door frame and is in contact with the insulating panel, the door liner being configured to define an insulating space, in which an insulator is disposed, together with the panel assembly and the door frame.

The door liner may include a contact surface that is in contact with the insulating panel. A recessed space may be defined on the contact surface.

The recessed space may be recessed from the contact surface in a direction that is away from the insulating panel.

The recessed space may be continuous along the contact surface.

The door liner may include an inner body configured to define a liner opening that is covered by the insulating panel. The inner body may be in contact with the contact surface.

The inner body may include: a first body; and a second body extending from the first body and having the contact surface and the recessed space. A portion of the second body, on which the contact surface is disposed, may have a thickness greater than that of a portion of the second body, on which the contact surface is disposed.

The second body may include: an outer surface configured to define the liner opening; and an inner surface configured to define the insulating space. The contact surface may be configured to connect the outer surface to the inner surface.

The outer surface and the first body may be configured to define a continuous surface so as to define a straight line.

An angle defined by the contact surface and the outer surface may be greater than that defined by the contact surface and the inner surface.

An angle defined by the contact surface and the outer surface may be an acute angle, and an angle defined by the inner surface and the contact surface may be an obtuse angle.

The recessed space may be disposed closer to the inner surface than the outer surface.

In the second body, a portion of the second body between the recessed space and the inner surface may have a width less than that of a portion of the second body between the recessed space and the outer surface.

The recessed space may have a depth less than a minimum thickness of the second body. The recessed space may have a depth less than a maximum width of the recessed space.

The maximum width of the recessed space may be less than a minimum distance between the recessed space and the outer surface.

A distance between the inner surface and the outer surface may gradually increase from the first body toward the insulating panel.

A distance from the recessed space to the inner surface may be less than that from the recessed space to the outer surface.

The recessed space may have a depth greater than the distance from the recessed space to the inner surface.

In another embodiment, a refrigerator includes: a cabinet having a storage space; and a door configured to open and close the storage space.

The door may include: a panel assembly including a front panel and an insulating panel spaced apart from the front panel; a door frame connected to the panel assembly; and a door liner configured to define an insulating space, in which an insulator is disposed, together with the panel assembly and the door frame.

The door frame may include an injection portion through which a foaming liquid for forming the insulator is injected.

A portion of the injection portion may be configured to guide the foaming liquid from the outside of the insulating space to the insulating space, and the other portion of the injection portion may be configured to guide the foaming liquid so that the foaming liquid flows in the insulating space.

The panel assembly may include: a front panel; and an insulating panel spaced apart from the front panel.

A portion of the injection portion may include a guide tube through which the foaming liquid passes through the door frame, and the other portion of the injection portion may include a guide groove configured to guide the foaming liquid passing through the guide tube.

The guide tube may be configured to guide the foaming liquid so that the foaming liquid flows into the insulating space in a first direction, and the guide groove may be configured to guide the foaming liquid so that at least a portion of the foaming liquid in the insulating space additionally flows in the first direction.

A cross-sectional area of the guide tube in a second direction perpendicular to the first direction may be greater than that of the guide groove.

The door frame may include a first frame connected to a rear surface of the front panel. The first frame may include the injection portion. The first frame may define an outer appearance of an upper portion of the door.

The first frame may include a front wall disposed to face the front panel; a rear wall spaced apart from the front wall; and a connection wall configured to connect a lower portion of the front wall to a lower portion of the rear wall, the connection wall being configured to define an accommodation space together with the front wall and the rear wall.

The connection wall may be configured to connect a lower portion of the front wall to a lower portion of the rear wall.

The guide tube may extend from the connection wall to the accommodation space, and the guide groove may be defined by recessing a portion of the connection wall.

The connection wall may include: a first surface configured to define the accommodation space; and a second surface configured to define the insulating space. The guide tube may extend from the first surface. The guide groove may be defined by recessing the second surface toward the rear wall.

The connection wall may include: a first wall extending from a lower end of the front wall toward the rear wall; a second wall extending to be inclined downward from the first wall toward the rear wall; and a third wall configured to connect the second wall to the rear wall.

The guide tube may extend from the first wall to the accommodation space. The guide groove may be defined in the second wall and the third wall.

An upper portion of the door frame may include an opening, the opening may be covered by a frame cover coupled to the door frame, and when the frame cover may be coupled to the door frame, the frame cover is configured to cover the guide tube.

A bottom surface of the frame cover may be seated on an end of the guide tube. A sensor module may be mounted in an accommodation space of the first frame. The sensor module may be configured to sense a knock applied to the front panel.

The injection portion may include a first injection portion and a second injection portion, which are spaced apart from each other in a horizontal direction.

The first frame may include: a first side wall and a second side wall, which are spaced apart from each other; and a hinge accommodation part having a recessed shape defined in the first side wall. The first injection portion and the second injection portion may be disposed between the hinge accommodation portion and the second side wall.

The door liner may include: a gasket coupling portion having a recessed shape to be coupled to the gasket and extending in a closed loop shape; and an air hole defined in the closed loop region, in which the gasket coupling portion is disposed, configured to discharge air within the insulating space.

The air hole may include: an inlet through which air of the insulating space is introduced; and an outlet through which air is discharged to the outside. The outlet may have a diameter less than that of the inlet.

When the gasket is coupled to the gasket coupling portion, the gasket may be configured to cover the air hole.

The door liner may include a contact surface that is in contact with the insulating panel, and a recessed space may be defined in the contact surface.

The recessed space may be recessed from the contact surface in a direction that is away from the insulating panel.

The recessed space may be continuous along the contact surface.

The door liner may include an inner body configured to define a liner opening that is covered by the panel assembly. The inner body may be in contact with the contact surface.

The inner body may include: a first body; and a second body extending from the first body and having the contact surface and the recessed space.

A portion of the second body, on which the contact surface is disposed, may have a thickness greater than that of a portion of the second body, on which the contact surface is disposed.

The second body may include: an outer surface configured to define the liner opening; an inner surface configured to define the insulating space; and the contact surface configured to connect the outer surface to the inner surface.

The outer surface and the first body may be configured to define a continuous surface so as to define a straight line.

An angle defined by the contact surface and the outer surface may be greater than that defined by the contact surface and the inner surface.

An angle defined by the contact surface and the outer surface may be an acute angle. An angle defined by the inner surface and the contact surface may be an obtuse angle.

The recessed space may be disposed closer to inner surface than the outer surface.

The recessed space may have a depth less than a minimum thickness of the second body. The recessed space may have a depth greater than a maximum width of the recessed space. The maximum width of the recessed space may be less than a minimum distance between the recessed space and the outer surface.

A distance between the inner surface and the outer surface may gradually increase from the first body toward the insulating panel.

The details of one or more embodiments are set forth in the accompanying drawings and the description below. Other features will be apparent from the description and drawings, and from the claims.

DETAILED DESCRIPTION OF THE EMBODIMENTS

Figure 1:
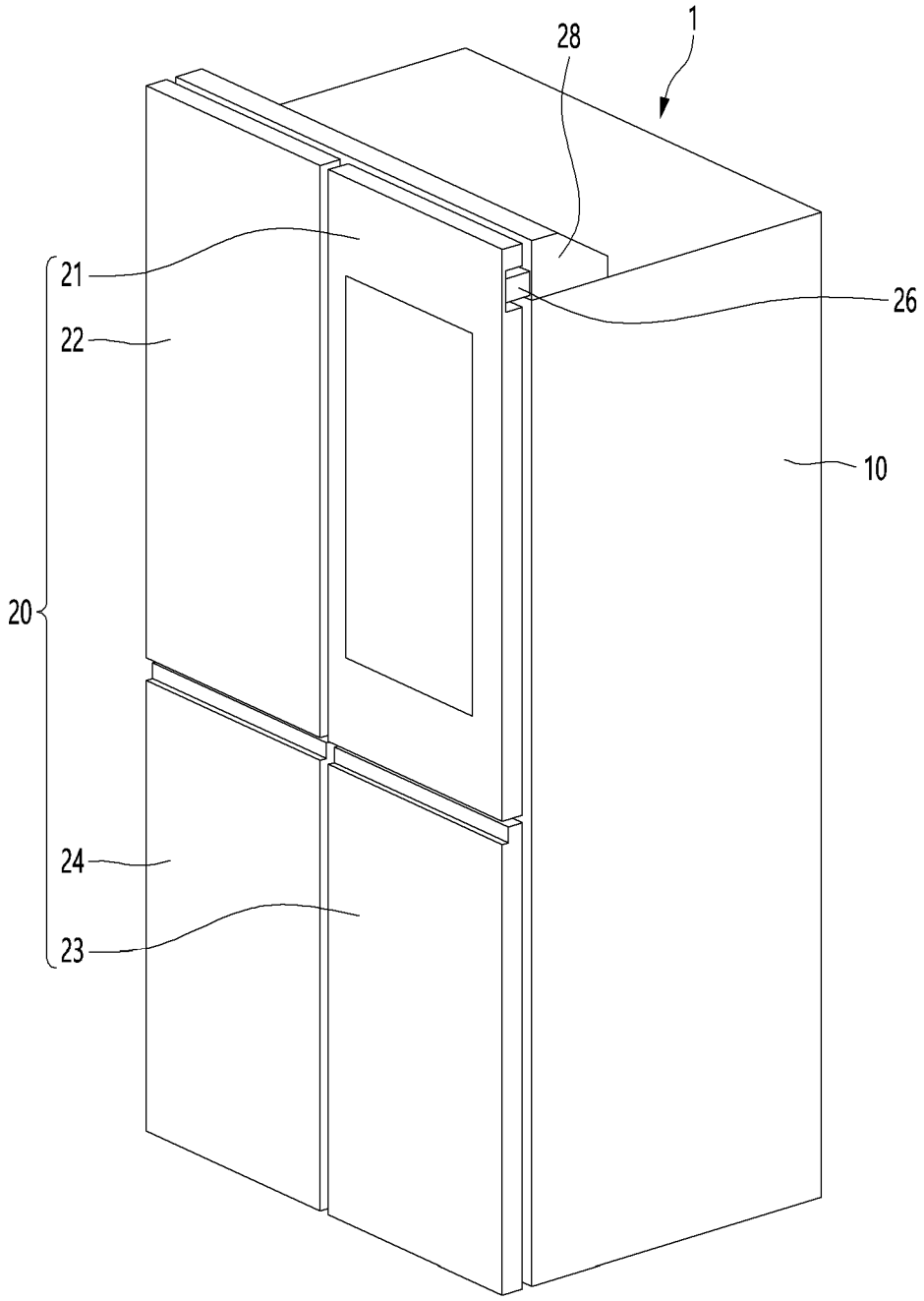
FIG. 1 is a perspective view illustrating a refrigerator according to an embodiment.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

FIG. 1 is a perspective view illustrating a refrigerator according to an embodiment.

Referring to FIG. 1, a refrigerator 1 according to this embodiment may include a cabinet 10 defining a storage space and a refrigerator door 20 opening and closing the storage space.

The storage space may include a plurality of storage areas, and the plurality of storage areas may be arranged in a vertical direction or a left and right direction.

The number of refrigerator doors 20 may vary according to the number of storage areas. For example, when the plurality of storage areas are arranged in the vertical direction, the first storage area doors 21 and 22 may open and close the upper first storage area, and the second storage area doors 23 and 23 may open and close the lower second storage area. The first storage area may be, for example, a refrigerating area, and the second storage area may be a freezing area, and vice versa.

In this case, one storage area may be opened and closed by one door or a plurality of doors in a rotating or sliding manner.

In FIG. 1, for example, the upper first storage area is opened and closed while the first storage area doors 21 and 22 arranged in the left and right directions rotate by a hinge 26. The hinge 26 may be at least partially covered by the hinge cover 28.

The first storage area doors 21 and 22 may include a left door and a right door.

Figure 2:
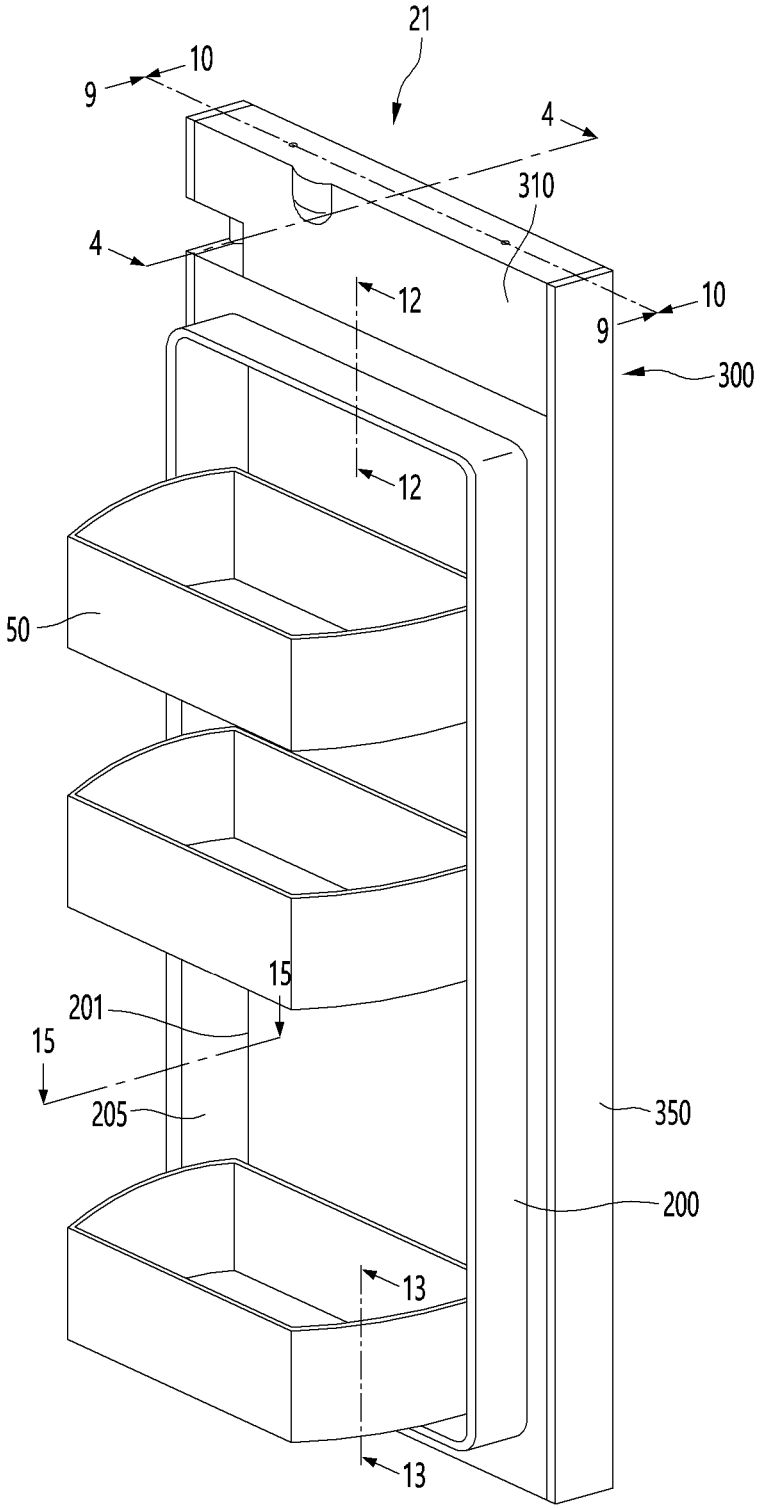
FIG. 2 is a rear perspective view of a first storage area door according to an embodiment.
Figure 3:
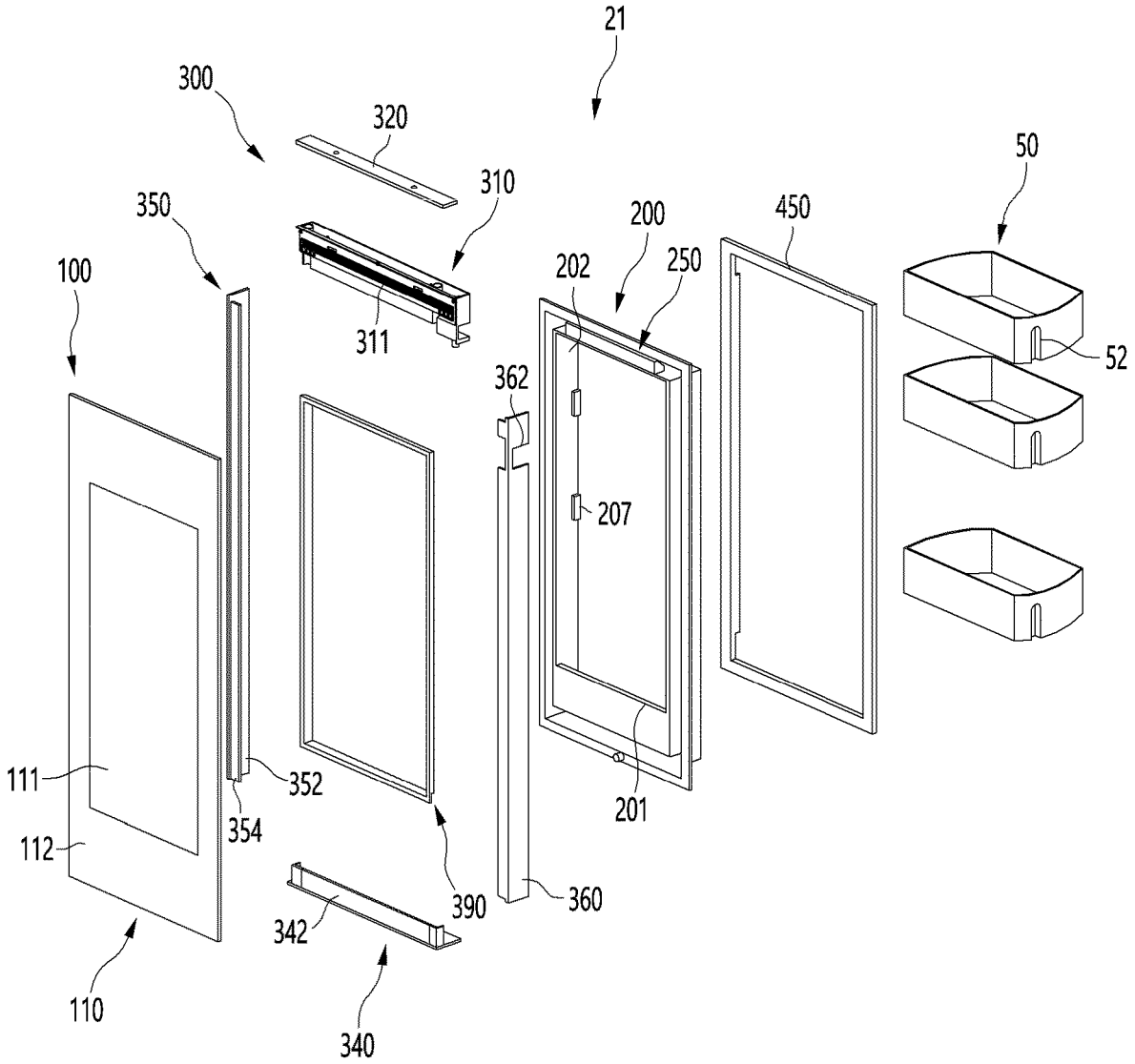
FIG. 3 is an explode perspective view of the first storage area door of FIG. 2.
Figure 4:
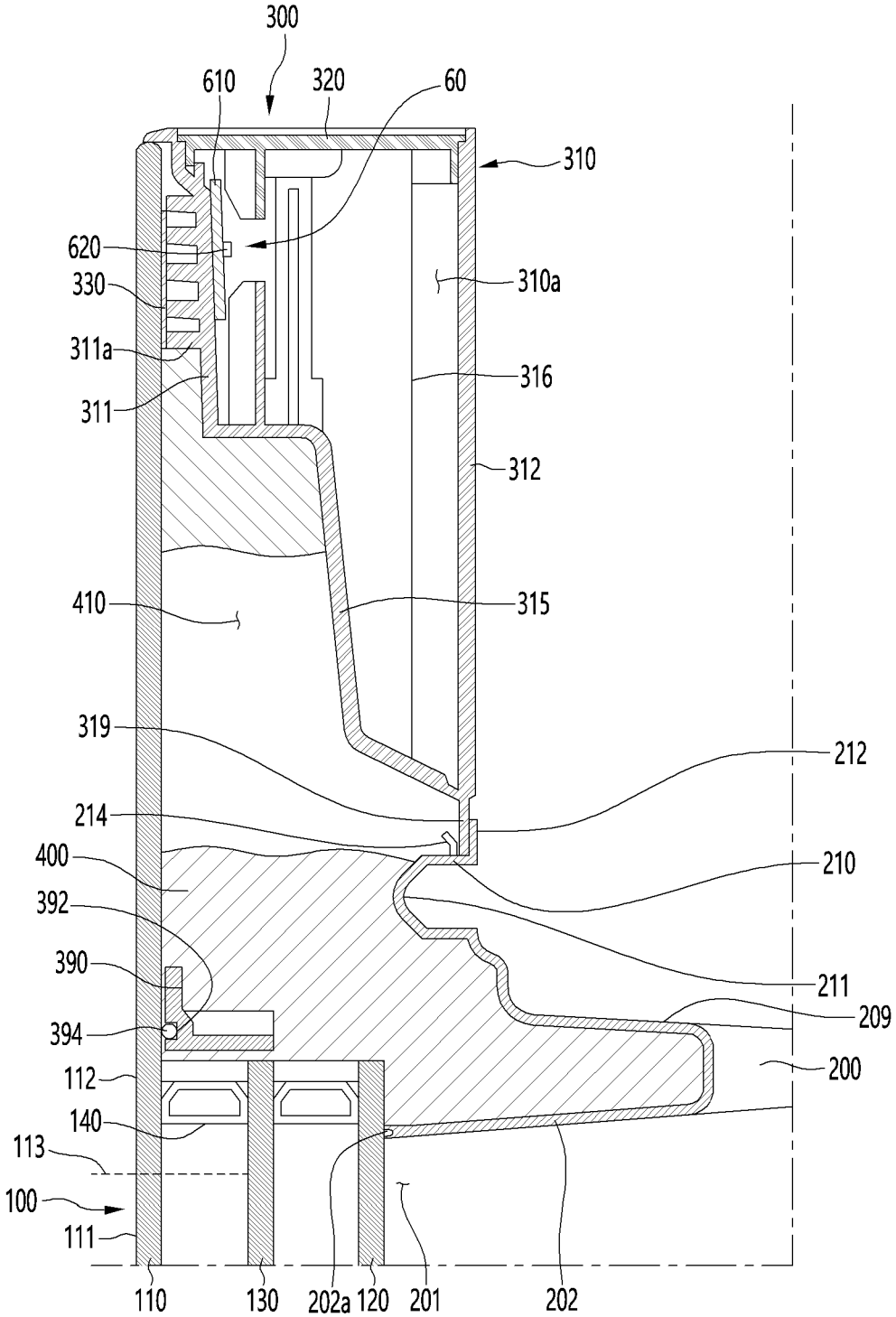
FIG. 4 is a cross-sectional view taken along line 4-4 of FIG. 2.

FIG. 2 is a rear perspective view of the first storage area door according to an embodiment, FIG. 3 is an explode perspective view of the first storage space door of FIG. 2, and FIG. 4 is a cross-sectional view taken along line 4-4 of FIG. 2.

In FIG. 2, for example, a rear surface of the first storage area door disposed at the right side is illustrated.

Hereinafter, the right first storage area door will be described with reference to FIGS. 2 to 4.

The first storage area door 21 includes a door frame 300 defining an outer appearance thereof, a panel assembly 100 coupled to the door frame 300, and a door liner 200 defining an insulating space 410, in which the insulator 400 is disposed, together with the door frame 300 and the panel assembly 100.

The door frame 300 may be provided or assembled in the shape of a rectangular frame having an opening, and the panel assembly 100 or the door liner 200 may cover the opening of the door frame 300.

The door liner 200 may include a liner opening 201. The panel assembly 100 may cover liner opening 201.

The panel assembly 100 may include a front panel 110. The front panel 110 may define an outer appearance of a front surface of the first storage area door 21.

The front panel 110 may be made of a glass material or a transparent plastic material. The front panel 110 may include a first portion 111 and a second portion 112 disposed outside the first portion 111. The second portion 112 is disposed to surround the first portion 111.

A printed layer may be disposed along a circumference of an edge of a rear surface of the front panel 110, and the first portion 111 and the second portion 112 may be distinguished from each other by the printed layer. The printed layer may be referred to as a bezel. That is, a portion of the front panel 110 at which the printed layer is provided may be defined as the second portion 112.

The first portion 111 may be a portion through which light irradiated from a lighting unit 250 is transmitted, and the printed layer may restrict or block the light transmission through the second portion 112.

The panel assembly 100 may further include one or more insulating panels 120 and 130 disposed behind the front panel 110.

In FIG. 4, for example, two insulating panels are illustrated to be disposed behind the front panel 110, but one insulating panel may be disposed behind the front panel 110.

The insulating panels 120 and 130 may include the first insulating panel 120 and the second insulating panel 130.

The first insulating panel 120 may be disposed behind the front panel 110, and the second insulating panel 130 may be disposed between the front panel 110 and the first insulating panel 120.

A spacer 140 is provided between the front panel 110 and the second insulating panel 130, and an insulating space is provided between the front panel 110 and the second insulating panel 130. An insulating gas may be injected into the insulating space, or the insulating space may be in a vacuum state to define a vacuum insulating space.

A spacer 140 is provided between the second insulating panel 130 and the first insulating panel 120, and an insulating space is provided between the second insulating panel 130 and the first insulating panel 120. An insulating gas may be injected into the insulating space, or the insulating space may be in a vacuum state to define a vacuum insulating space.

Each of the insulating panels 120 and 130 may be made of a glass material or a transparent plastic material.

The spacer 140 may be disposed to face the second portion 112 so that the spacer 140 is not exposed to the outside.

A left and right width and a height of the front panel 110 may be greater than a left and right width and a height of the respective insulating panels 120 and 130.

Thus, the spacer 140 may be disposed at a position that is spaced a predetermined distance inward from an outer end of the front panel 110. That is, the spacer 140 may be disposed between a boundary line 113 between the first portion 111 and the second portion 112 and the outer end of the front panel 110.

The first storage area door 21 may further include a heater frame 390 attached to the rear surface of the front panel 110 by an adhesion portion. The heater frame 390 may be provided in the form of a rectangular frame, be disposed behind the front panel 110, and be disposed between the front panel 110 and the second insulating panel 130 outside the spacer 140 to surround the spacer 140. That is, the spacer 140 may be disposed in a region defined by the heater frame 390.

A groove 392 accommodating a heater 394 may be defined in a front surface of the heater frame 390. The heater 394 may provide heat to the front panel 110 to prevent water droplets from being generated on the front panel 110. The heater frame 390 may be attached to a rear surface of the second portion 112 of the front panel 110 so that the heater frame 390 is not exposed to the outside.

The door frame 300 may be provided by a single frame or by assembling a plurality of frames.

The door frame 300 may be fixed to the rear surface of the front panel 110 by an adhesion portion 330. The adhesion portion 330 may be, for example, an adhesive or a double-sided tape.

The adhesion portion 330 may be disposed on the rear surface of the second portion 112 of the front panel 110 so that the adhesion portion 330 is not exposed to the outside.

In the state in which the door frame 300 is attached to the front panel 110, the door frame 300 may cover a circumferential surface (including a top surface, a bottom surface, and both side surfaces) of the front panel 110.

The door frame 300 may include an upper frame 310 (or a first frame). The upper frame 310 may define an outer appearance of an upper portion of the first storage area door 21.

The door frame 300 may further include a lower frame 340 (or a second frame) spaced apart from the upper frame 310. The door frame 300 may further include a pair of side frames 350 and 360 connecting the upper frame 310 to the lower frame 340.

The upper frame 310 may have an accommodation space 310*a* in which various components such as an electric wire are disposed, and the accommodation space 310*a* may be covered by the frame cover 320.

Each of the side frames 350 and 360 may include a side surface portion 352 that is in contact with side surfaces of the upper frame 310 and the lower frame 340 and a front surface portion 354, which extends from the side surface portion 352 in a direction crossing the side surface portion 352 and is in contact with a front wall 311 of the upper frame 310 and a front wall 342 of the lower frame 340.

The front surface portion 354 may extend from the side surface portion 352 at a position spaced a predetermined distance backward from a front end of the side surface portion 352.

A front surface of the front surface portion 354 may adhere to a rear surface of the front panel 110 by the adhesion portion.

A rear surface of the front surface portion 354 may be in contact with front surfaces of the upper frame 310 and the lower frame 340 and be coupled to the upper frame 310 and the lower frame 340 by a coupling member such as, for example, a screw.

A slot 362 providing a space in which a hinge 26 is disposed may be provided in any one of the pair of side frames 350 and 360.

The door liner 200 may include an inner body 202 defining the liner opening 201. The inner body 202 may include an upper body, a lower body, and a pair of side bodies.

A coupling protrusion 207 coupled to a basket 50 may be provided on each of the side bodies of the inner body 202. For example, the coupling protrusion 207 may be provided on each of the side bodies 205. In each of the side bodies, a plurality of coupling protrusions 207 may be disposed to be spaced apart from each other in the vertical direction. A protrusion groove 52 that receives the coupling protrusion 207 may be defined in each of both side walls of the basket 50.

Thus, when the basket 50 moves downward in a state in which the basket 50 is disposed in the liner opening 201 of the inner body 202, the coupling protrusion 207 may be accommodated in the protrusion groove 52 so that the basket 50 is supported by the protrusion groove 52.

In a state in which the basket 50 is mounted on the door liner 200, at least a portion of the basket 50 may be disposed to face the first portion 111 of the front panel 110. Thus, when the lighting unit 250 operates, the basket 50 and the foods accommodated in the basket 50 may be visible from the outside by the light passing through the first portion 111.

An end 202*a* of the inner body 202 may be in contact with the panel assembly 100. For example, the end 202*a* of the inner body 202 may be in contact with the rear surface of the first insulating panel 120.

Here, the end 202*a* of the inner body 202 may be in contact with a position spaced a predetermined distance inward from the outer end the first insulating panel 120.

The door liner 200 may further include an outer body 210 and a connection body 209 connecting the outer body 210 to the inner body 202.

The door liner 200 may include a gasket coupling portion 211 to which the gasket 450 is coupled. The gasket coupling portion 211 may be provided in a recessed shape, and the outer body 210 and the connection body 209 may provide the gasket coupling portion 211. The gasket coupling portion 211 may extend in a closed loop shape.

The lighting unit 250 may be installed on the door liner 200. For example, the lighting unit 250 may be installed on the inner body 202, and a portion of the lighting unit 250 may be disposed to face the liner opening 201.

The door liner 200 may further include a liner extension portion 212 that is bent around the outer body 210 to extend and is in contact with the door frame 300. The liner extension portion 212 may extend from the outer body 210 in a direction crossing the outer body 210.

The liner extension portion 212 may be in contact with a frame extension portion 319 provided on the rear wall 312 of the upper frame 310 and the rear wall 344 (see FIG. 13) of the lower frame 340.

The liner extension portion 212 and the frame extension portion 319 may adhere to each other by the adhesion portion. In this case, the adhesion portion may be provided on a portion or the whole of the contact portions between the liner extension portion 212 and the door frame 300. Alternatively, the liner extension portion 212 and the frame extension portion 319 may be in contact with each other without the adhesion portion.

In this embodiment, it will be defined and described that the two members are in contact with each other even when the two members are coupled to each other in a state in which the adhesion portion is disposed between the two members.

Also, the liner extension portion 212 may be in contact with a rear side of each of the side frames 350 and 360.

The insulating space 410, in which the insulator 400 is disposed may be defined by the door frame 300, the panel assembly 100, and the door liner 200.

The door frame 300 may include an injection portion for injecting the foaming liquid. The injection portion will be described later with reference to the drawings.

As the foaming liquid is injected through the injection portion, and the foaming liquid is hardened, the insulator 400 may be disposed in the insulating space 410.

In the process of curing the foaming liquid, the foaming liquid is combined with a structure that is in contact with the foaming liquid. That is, the foaming liquid not only serves for insulation, but also serves as a connection portion that connects two spaced structures to each other.

For example, a portion of the insulator 400 may be disposed to surround the insulating panels 120 and 130 in the panel assembly 100, and in particular may be in contact with a rear surface of the first insulating panel 120.

A portion of the insulator 400 that is in contact with the rear surface of the first insulating panel 120 is in contact with the inner body 202 of the door liner 200. Thus, the insulator 400 serves to connect the door liner 200 to the panel assembly 100.

Also, the other portion of the insulator 400 is in contact with the frame extension portion 319 the upper frame 310 and the outer body 210 of the door liner 200. Thus, the insulator 400 connects the door liner 200 to the upper frame 310.

A rib 214 extending upward may be provided on a top surface of the outer body 210. The rib 214 is disposed to be spaced apart from the liner extension portion 212.

For example, the rib 214 may be disposed to be spaced apart from the liner extension portion 212 in a forward direction toward the front panel 110. A space, in which the frame extension portion 319 disposed is defined in a gap between the rib 214 and the liner extension portion 212.

Thus, the frame extension portion 319 seated on the outer body 210 between the rib 214 and the liner extension portion 212.

A sensor module 60 may be mounted on the upper frame 310. The sensor module 60 may sense the knock input, and when the sensed knock input is an effective knock input, the lighting unit 250 may operate while the first storage area door 21 is closed.

The sensor module 60 may include a sensor element 620 and a sensor PCB 610 on which the sensor element 620 is installed.

The sensor element 620 may be, for example, an acceleration sensor. When a knock is applied to the front surface of the front panel 110, vibration is generated in the front panel 110 by the knock, and the vibration generated in the front panel 110 is transmitted to the acceleration sensor through the front wall 311 of the upper frame 310 and the sensor PCB 610.

When an intensity of the vibration generated by knocking two or more times within a predetermined time is equal to or greater than a reference intensity, it is determined as an effective knock input, and in this case, the lighting unit 250 may operate.

The upper frame 310 may include the front wall 311 and a rear wall 312 disposed to face the front wall 311.

A vertical length of the front wall 311 is less than that of the rear wall 312. A lower end of the front wall 311 may be disposed higher than a lower end of the rear wall 312. A lower side of the front wall 311 and a lower side of the rear wall 312 may be connected to each other by a connection wall 315.

The front wall 311 may include a protrusion rib 311*a* that protrudes forward, and the protrusion rib 311*a* may be attached to a rear surface of the front panel 110 by the adhesion portion 330. That is, the front wall 311 may be connected to the rear surface of the front panel 110.

Here, a plurality of protrusion ribs 311*a* may be disposed to be spaced apart from each other in the vertical direction, and each of the protrusion ribs 311*a* may extend lengthily in the horizontal direction.

The sensor module 60 may be installed on the front wall 311 in the upper frame 310. When the sensor module 60 is installed on the front wall 311, the sensor module 60 may face the protrusion rib 311*a*.

Figure 5:
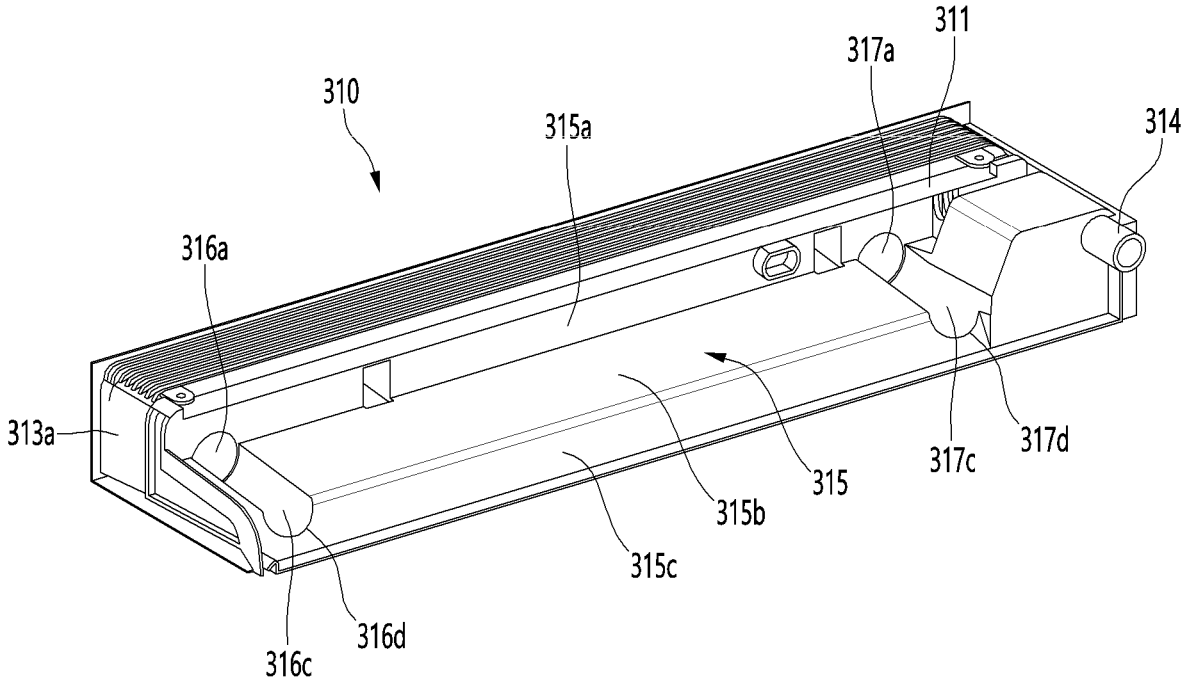
FIG. 5 is a perspective view of an upper frame when viewed downward from a front side of the upper frame according to an embodiment.
Figure 6:
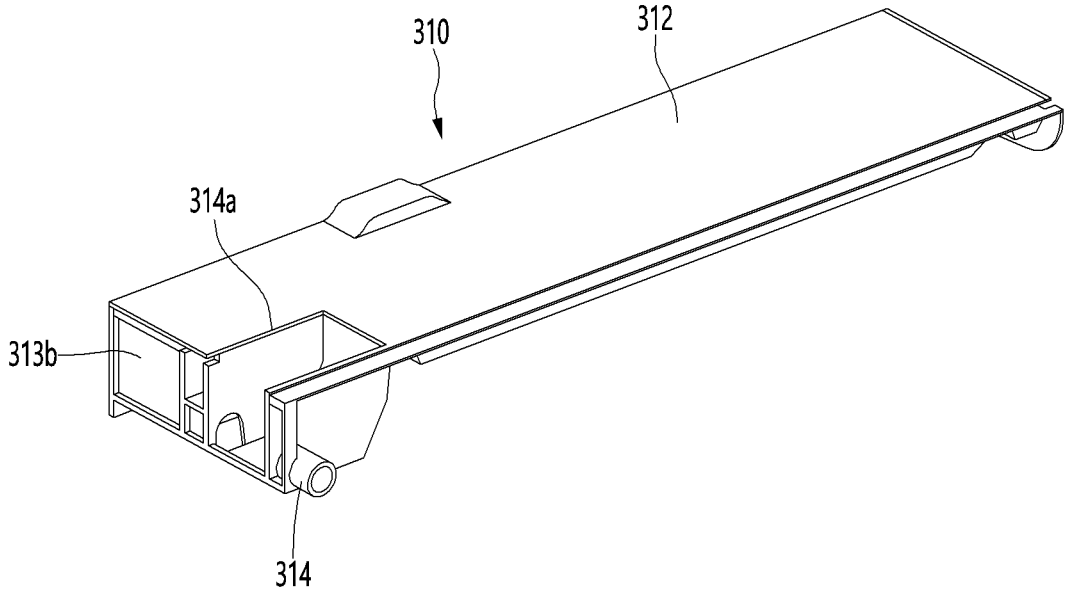
FIG. 6 is a perspective view of the upper frame when viewed downward from a rear side of the upper frame according to an embodiment.
Figure 7:
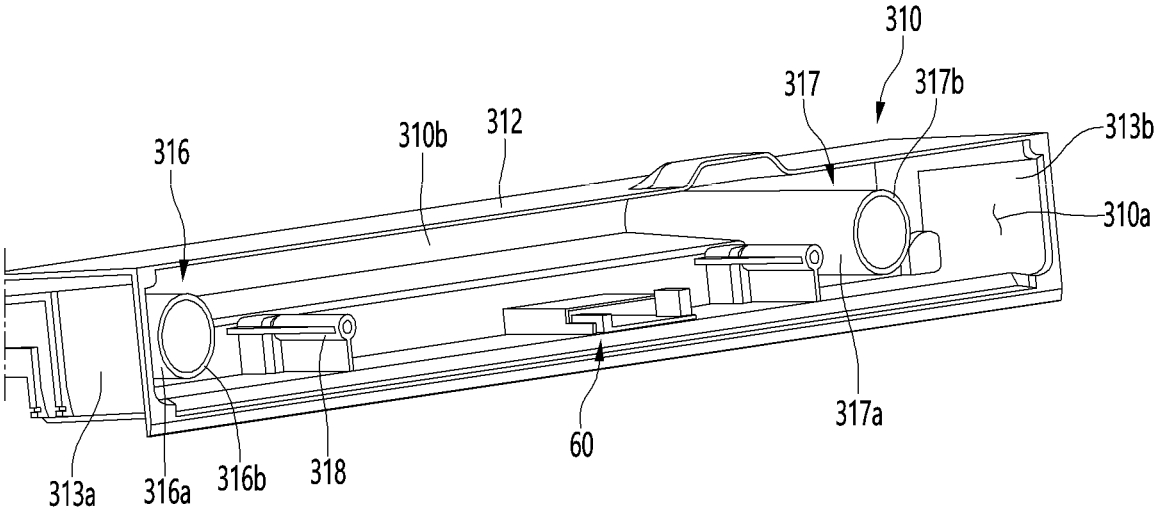
FIG. 7 is a perspective view of the upper frame when viewed from an upper side of the upper frame according to an embodiment.

FIG. 5 is a perspective view of the upper frame when viewed downward from a front side of the upper frame according to an embodiment, and FIG. 6 is a perspective view of the upper frame when viewed downward from a rear side of the upper frame according to an embodiment. FIG. 7 is a perspective view of the upper frame when viewed from an upper side of the upper frame according to an embodiment.

Referring to FIGS. 4 to 7, the upper frame 310 may include a front wall 311 and a rear wall 312, a pair of side walls 313*a* and 313*b* connecting the front wall 311 to the rear wall 312, and a connection wall 315 connecting a lower portion of the front wall 311, a lower portion of the rear wall 312, and lower portions of the pair of side walls 313*a* and 313*b* to each other.

Thus, the upper portion of the upper frame 310 includes an opening 310*b*. The walls 311, 312, 313*a*, 313*b*, and 315 of the upper frame 310 define an accommodation space 310*a*. The accommodation space 310*a* is partitioned from the insulating space 410.

Thus, the sensor module 60 may be accommodated in the accommodation space 310*a* through the opening 310*b*.

A hinge accommodation portion 314*a* having a shape that is recessed so that the hinge 26 is disposed may be defined in the rear wall 312 of the upper frame 310, and a guide 314 through which a shaft (not shown) provided on the hinge 26 passes may be provided below the hinge accommodation portion 314*a*.

The upper frame 310 may include a coupling boss 318 coupled to the frame cover 320. In a state in which a portion of the frame cover 320 is seated on a top surface of the coupling boss 318, a coupling member may pass through the frame cover 320 from an upper side of the frame cover 320 and then be coupled to the coupling boss 318.

The connection wall 315 may be bent one or more times. For example, the connection wall 315 may include a first wall 315*a* extending from the front wall 311 toward the rear wall 312, a second wall 315*b* extending to be inclined downward from the first wall 315*a* toward the rear wall 312, and a third wall connecting the second wall 315*b* to the rear wall 312.

A portion of the front wall 311 may be spaced apart from the rear surface of the front panel 110 so that the insulator 400 is disposed between the front wall 311 and the rear surface of the front panel 110. That is, a portion of the front wall 311 may be in contact with the insulator 400.

The connection wall 315 may also be in contact with the insulator 400. For example, each of the first to third walls 315*a*, 315*b*, and 315*c* may be in contact with the insulator 400.

The upper frame 310 may include injection portions 316 and 317 for injecting the foaming liquid.

The upper frame 310 may include the plurality of injection portions 316 and 317 so that the foaming liquid is uniformly distributed in the insulating space 410.

The plurality of injection portions 316 and 317 may include a first injection portion 316 and a second injection portion 317, which are spaced apart from each other in a horizontal direction.

For example, the first and second injection portions 316 and 317 may be disposed to be spaced apart from each other in a left and right direction in the upper frame 310.

The first injection portion 316 and the second injection portion 317 may be disposed between the first side wall 313*a* and the second side wall 313*b*. Here, the first injection portion 316 may be disposed close to the first side wall 313*a*, and the second injection portion 317 may be disposed close to the second side wall 313*b*. The second side wall 313*b* is disposed close to the hinge accommodation portion 314*a*.

The first injection portion 316 and the second injection portion 317 serve to guide the foaming liquid, which is injected through a foaming liquid injection nozzle (not shown) disposed above the upper frame 310, to a lower side of the upper frame in the process of injecting the foaming liquid.

The first injection portion 316 may include a first guide tube 316*a* disposed in the accommodation space 310*a* and a first guide groove 316*c* disposed below the first guide tube 316*a*.

The first guide tube 316*a* and the first guide groove 316*c* provide a passage through which the foaming liquid flows.

The first guide tube 316*a* may be spaced apart from the front wall 311, the pair of side walls 313, and the rear wall 312.

The first guide tube 316*a* may include a first inlet 316*b*. The first guide tube 316*a* may extend in the vertical direction within the accommodation space 310*a*. For example, the first guide tube 316*a* may extend upward from the connection wall 315.

The first guide tube 316*a* is disposed in the accommodation space 310*a* defined by the upper frame 310, and the first guide groove 316*c* is disposed outside the upper frame 310.

The first guide tube 316*a* may guide the foaming liquid from the outside of the insulating space 410 to the insulating space 410, and the first guide groove 316*c* may continuously guide the foaming liquid (the foaming liquid passing through the first guide tube 316*a*) discharged from the upper frame 310 downward in the insulating space 410. The outside of the insulating space 410 is substantially the inner space of the upper frame 310.

For example, in the first guide tube 316*a*, the foaming liquid may be guided to flow in a first direction, and in the first guide groove 316*c*, at least a portion of the foaming liquid may be guided to additionally flow in the first direction in the insulating space 410.

As a portion of the connection wall 315 is recessed toward the rear wall 312, the first guide groove 316*c* may be defined.

For example, the connection wall 315 may include a first surface defining the accommodation space 310*a* and a second surface defining the insulating space 410.

The first guide tube 316*a* may extend from the first surface, and the first guide groove 316*c* may be defined by recessing the second surface. For example, the first guide groove 316*c* may be recessed from the second surface toward the rear wall 312.

The first guide groove 316*c* may extend vertically from the connection wall 315. The first guide groove 316*c* may be defined in the second wall 315*b* and the third wall 315*c*. The first guide tube 316*a* may extend from the first wall 315*a*.

The first guide groove 316*c* may include a first outlet 316*d*. The first outlet 316*d* may be disposed on the third wall 315*c*.

A horizontal cross-section of the first guide tube 316*a* may have a circular shape, and a horizontal cross-section of the first guide groove 316*c* may have a semicircular shape or a shape similar to the semicircular shape. That is, a cross-sectional area of the first guide tube 316*a* in a second direction perpendicular to the first direction is greater than a cross-sectional area of the first guide groove 316*c*.

The second injection portion 317 may have substantially the same shape as the first injection portion 316. The second injection portion 317 may be disposed at a position avoiding the hinge accommodation portion 314*a*. For example, the first injection portion 316 and the second injection portion 317 may be disposed between the hinge accommodation portion 314*a* and the first side wall 313*a*.

The second injection portion 317 may include a second guide tube 317*a* disposed in the space 310*a* and a second guide groove 317*c* disposed below the second guide tube 317*a*. A distance between a reference line and the second guide tube 317*a* may be less than a distance between the reference line and the first guide tube 316*a* based on the reference line that bisects the upper frame 310 in the left and right direction.

Each of the second guide tube 317*a* and the second guide groove 317*c* provides a passage through which the foaming liquid flows.

The second guide tube 317*a* may be spaced apart from the front wall 311, the pair of side walls 313, and the rear wall 312.

The second guide tube 317*a* may include a second inlet 317*b*. The second guide tube 317*a* may extend in the vertical direction in the accommodation space 310*a*. The second guide tube 317*a* may extend upward from the connection wall 315.

The second guide tube 317*a* may be disposed inside the upper frame 310, and the second guide groove 317*c* may be disposed outside the upper frame 310.

The second guide tube 317*a* may guide the foaming liquid from the outside of the insulating space 410 to the insulating space 410, and the second guide groove 317*c* may continuously guide the foaming liquid discharged from the upper frame 310 downward in the insulating space 410.

For example, in the second guide tube 317*a*, the foaming liquid may be guided to flow in a first direction, and in the second guide groove 317*c*, the foaming liquid may be guided to additionally flow in the first direction in the insulating space 410.

As a portion of the connection wall 315 is recessed toward the rear wall 312, the second guide groove 317*c* may be defined.

The second guide groove 317*c* may extend vertically from the connection wall 315. The second guide groove 317*c* may be defined in the second wall 315*b* and the third wall 315*c*.

The second guide tube 317*a* may extend from the first surface of the connection wall 315, and the second guide groove 317*c* may be defined by recessing the second surface of the connection wall 315. For example, the second guide groove 317*c* may be recessed toward the rear wall 312 from the second surface.

The second guide groove 317*c* includes a second outlet 317*d*. The second outlet 317*d* may be disposed on the third wall 315*c*.

A horizontal cross-section of the second guide tube 317*a* may have a circular shape, and a horizontal cross-section of the second guide groove 317*a* may have a semicircular shape. That is, a cross-sectional area of the second guide tube 317*a* in a second direction perpendicular to the first direction is greater than a cross-sectional area of the second guide groove 317*c*.

Figure 8:
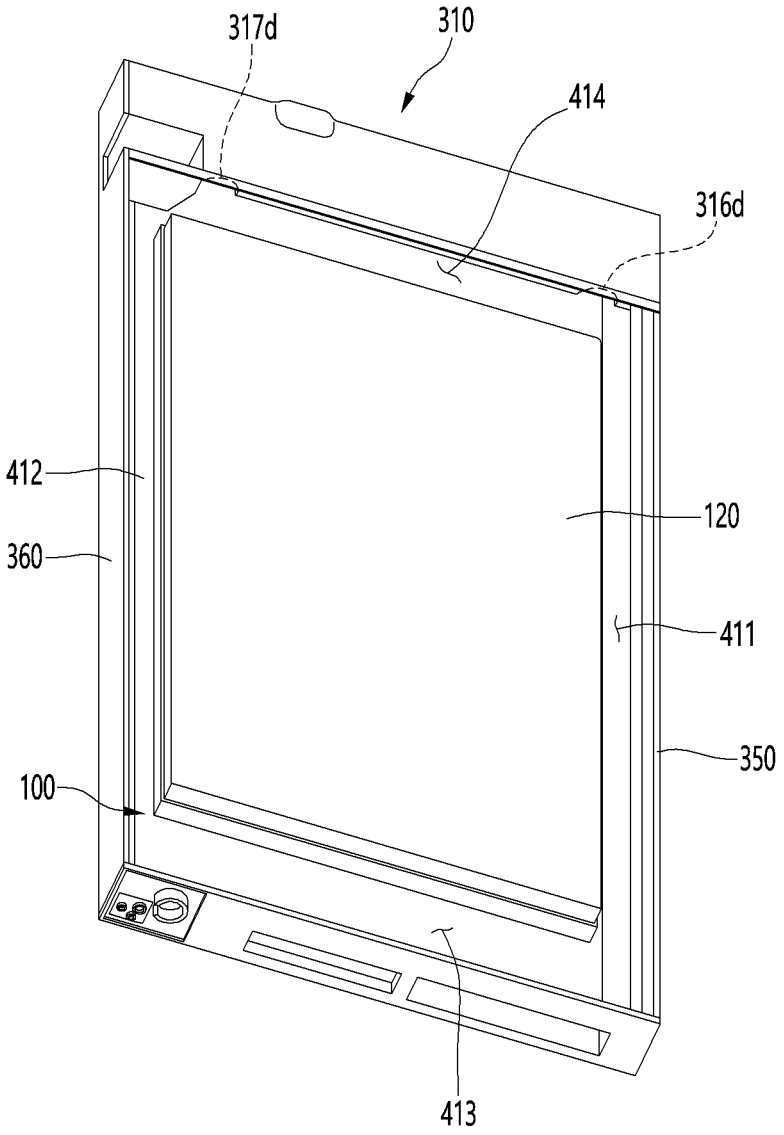
FIG. 8 is a view illustrating a state in which the first storage area door except for the door liner is assembled.
Figure 9:
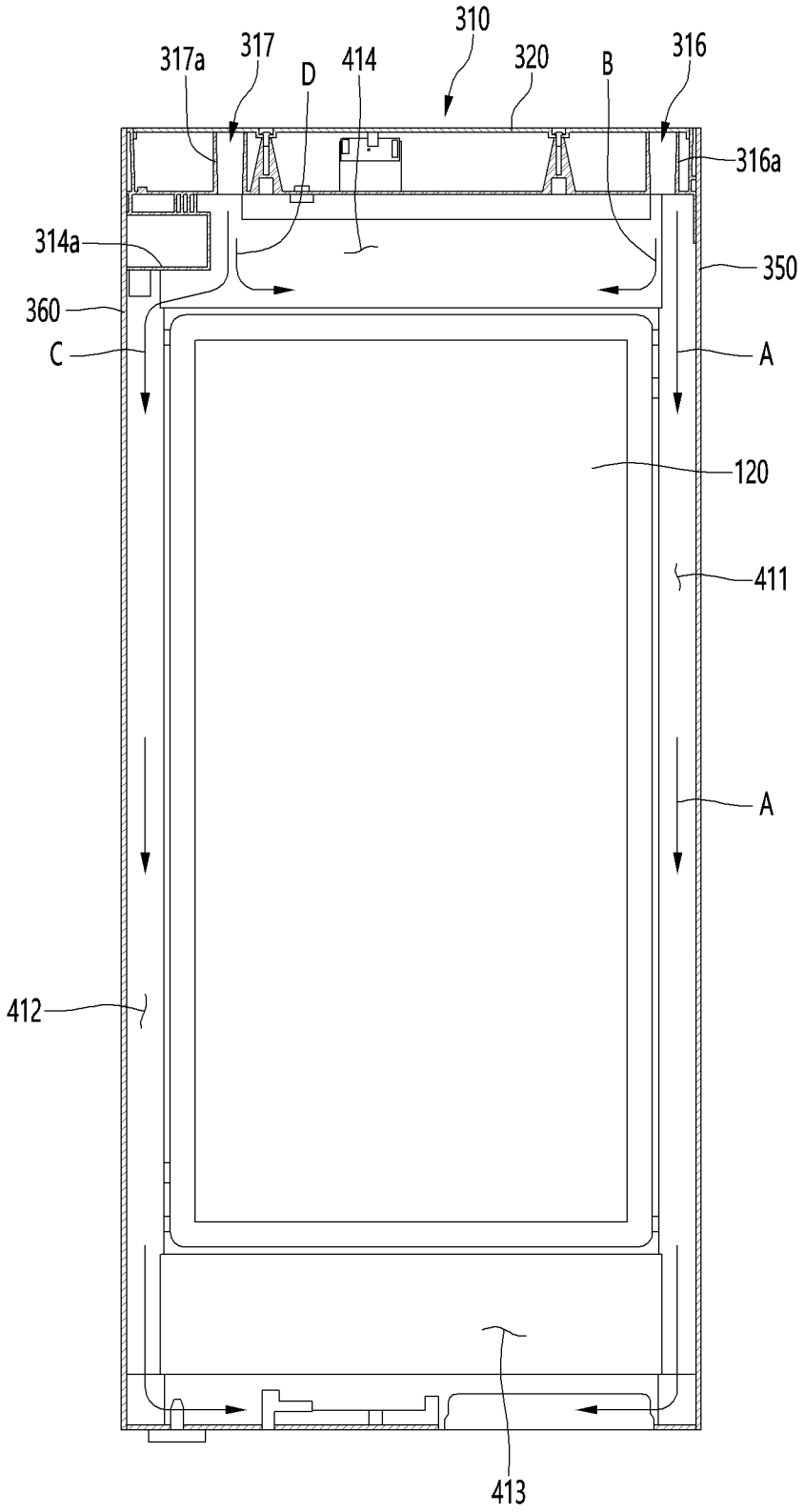
FIG. 9 is a cross-sectional view taken along line 9-9 of FIG. 2.
Figure 10:
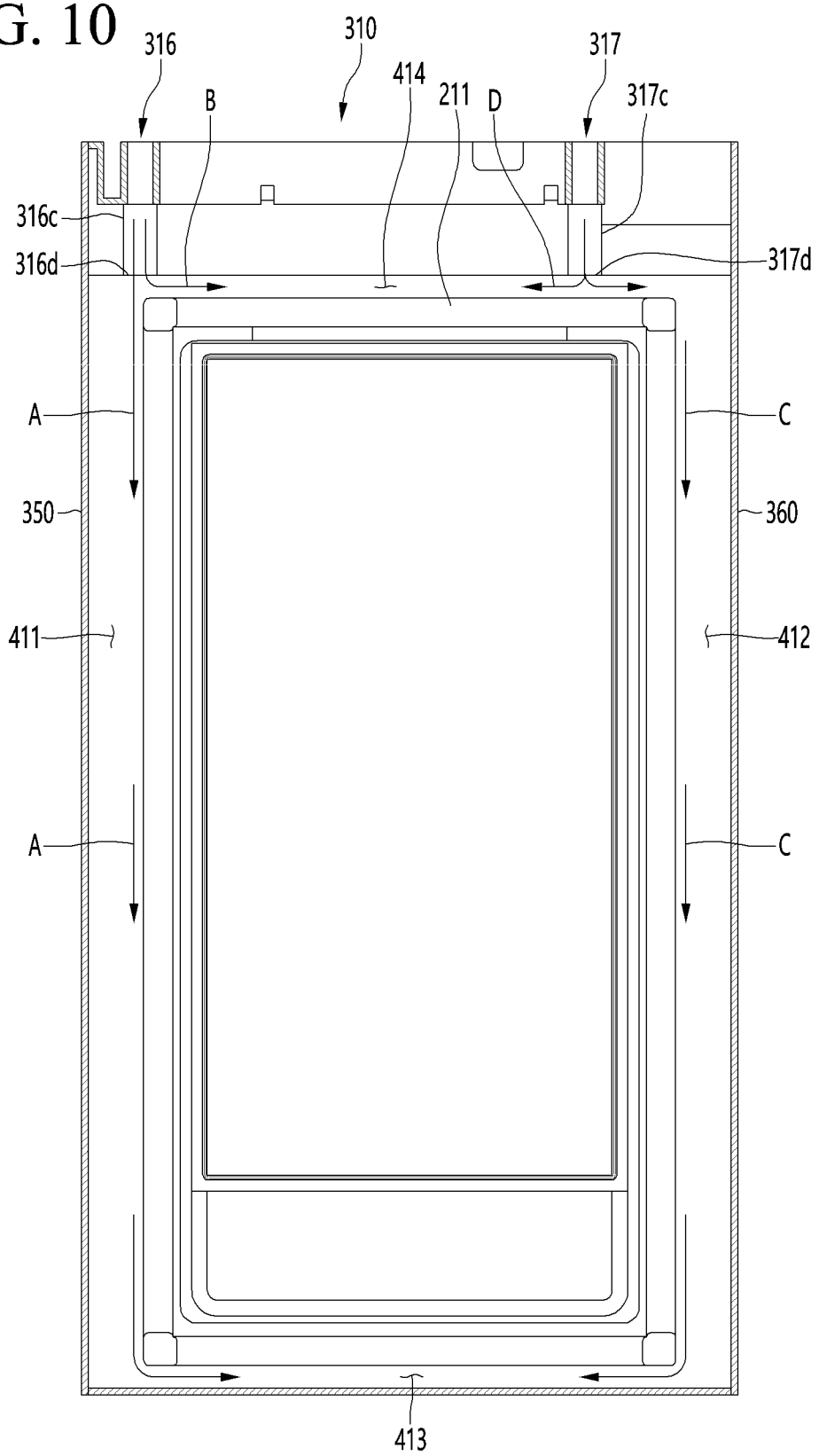
FIG. 10 is a cross-sectional view taken along line 10-10 of FIG. 2.
Figure 11:
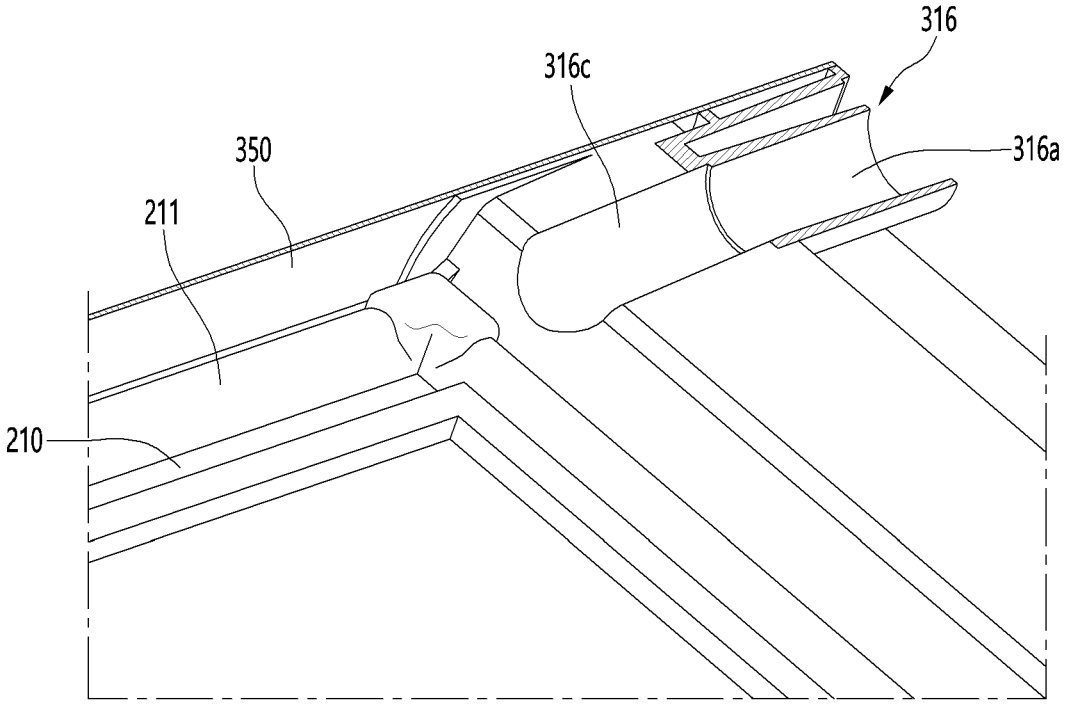
FIG. 11 is a perspective view illustrating an arrangement of a first injection portion and the door liner.

FIG. 8 is a view illustrating a state in which the first storage area door except for the door liner is assembled, FIG. 9 is a cross-sectional view taken along line 9-9 of FIG. 2, FIG. 10 is a cross-sectional view taken along line 10-10 of FIG. 2, and FIG. 11 is a perspective view illustrating an arrangement of the first injection portion and the door liner.

Referring to FIGS. 8 to 11, in a state in which the first storage area door 21 except for the door liner 200 is assembled, the insulating space 410 may include first to fourth spaces 411, 412, 413, and 414.

The first space 411 may be a space defined by one side surface of each of the insulating panel 120 and 130 and the first side frame 350. The first space 411 may extend in the vertical direction.

The first outlet 316*d* of the first injection portion 316 may be disposed to face the first space 411P. The first outlet 316*d* of the first injection portion 316 may be disposed above the first space 411.

The second space 412 may be a space defined by the other side surface of each of the insulating panels 120 and 130 and the second side frame 360. The second space 412 may extend in the vertical direction.

The third space 413 may be a space defined by a bottom surface of each of the insulating panels 120 and 120 and the lower frame 340. Also, the third space 413 may be a space defined by each of the side frames 350 and 360 and the lower frame 340.

The third space 413 may allow the first space 411 and the second space 412 to communicate with each other.

The fourth space 414 may be a space defined by a top surface of each of the insulating panels 120 and 130 and the upper frame 310. The fourth space 414 may allow the first space 411 and the second space 412 to communicate with each other.

In a state in which the door liner 200 is assembled, the first guide groove 316*c* and the second guide groove 317*c* are disposed in the insulating space. That is, according to this embodiment, the outlets 316*d* and 317*d* of the injection portions 316 and 317 are disposed in the insulating space 410.

According to this embodiment, when the outlets 316*d* and 317*d* of the injection portions 316 and 317 are disposed in the insulating space 410, straightness of the injected foaming liquid may be improved. That is, even in a state in which the foaming liquid is introduced into the insulating space 410, the foaming liquid may straightly flow to the outlets 316*d* and 317*d* by the first guide grooves 316*c* and 317*c*. For example, the straightness of the foaming liquid in the vertical direction may be improved.

The first storage area door 21 is provided to be longer in the vertical direction than the left and right width, and each of the first space 411 and the second space 412 extending in the vertical direction has a narrow horizontal cross-section due to the presence of the panel assembly 100. If the foaming liquid is not quickly filled in the insulating space 410, there is a limitation in that the foaming liquid is hardened before being filled in the insulating space 410 as a whole.

However, when the straightness of the foaming liquid is strengthened, like this embodiment, the foaming liquid may be quickly and uniformly distributed in the insulating space 410, and thus, the foaming liquid may be filled in the insulating space 410 as a whole.

In the state in which the door liner 200 is assembled, a portion of the first outlet 316*d* of the first injection portion 316 may be disposed to face the door liner 200, and the other portion may be disposed to face the first space 411.

Thus, a portion of the foaming liquid injected through the first injection portion 316 may move directly to the first space 411 (see an arrow A), and the other portion may collide with the door liner 200 to move to the fourth space 414 (see an arrow B).

Here, an amount of foaming liquid flowing into the first space 411 is greater than that of the foaming liquid flowing into the fourth space 414.

When the door liner 200 is assembled, the second outlet 317*d* of the second injection portion 317 may be disposed to face the door liner 200. For example, the second outlet 317*d* of the second injection portion 317 may be disposed to face the gasket coupling portion 211. A portion of the second inlet 317*b* may be disposed to face at least one insulating panel, and the other portion may be disposed to face the door liner 200.

Thus, the foaming liquid injected through the second injection portion 317 collides with the at least one insulating panel or the door liner 200. A portion of the foaming liquid may move to the second space 412 (see an arrow C), and the other portion may be filled in the fourth space 414 (see an arrow D).

The foaming liquid injected through the first injection portion 316 and the second injection portion 317 flows into the third space 413 through the first space 411 and the second space 412 so as to be filled first into the third space 413 and then and then filled into the first space 411 and the second space 412.

After the foaming liquid is filled in the first space 411 and the second space 412, the foaming liquid is filled in the fourth space 414.

After the fourth space 414 is filled with the foaming liquid, the supply of the foaming liquid may be finished.

When curing of the foaming liquid is completed in the state in which the foaming liquid is filled in the fourth space 414, a portion of the insulator 400 may be filled in the guide grooves 316*c* and 317*c*.

Even if the foaming liquid overflows from the fourth space 414 when the supply of the foaming liquid is finished, since the injection portions 316 and 317 include the guide tubes 316*a* and 317*a*, each of which has a predetermined length, the foaming liquid may be disposed in the guide tubes 316*a* and 317*a* to prevent the foaming liquid from overflowing to the outside of the upper frame 310.

Also, even if the foaming liquid is filled in the guide tubes 316*a* and 317*a*, since the inside of the guide tubes 316*a* and 317*a* is partitioned from the accommodation space 310*a* of the upper frame 310, a sensor module 60 within the accommodation space 310*a* may be prevented from being in contact with the foaming liquid or the insulator within the guide tubes 316*a* and 317*a*.

Thus, since the sensor module 60 is accessible through the opening 310*b* of the upper frame 310 even after the formation of the insulator 400 is completed, service of the sensor module 60 is possible.

The inlets 316*b* and 317*b* of each of the injection portions 316 and 317 may be covered by the frame cover 320 when the frame cover 320 is coupled to the upper frame 310. Although not limited, an upper end of each of the guide tubes 316*a* and 317*a* may be in contact with the bottom surface of the frame cover 320.

Figure 12:
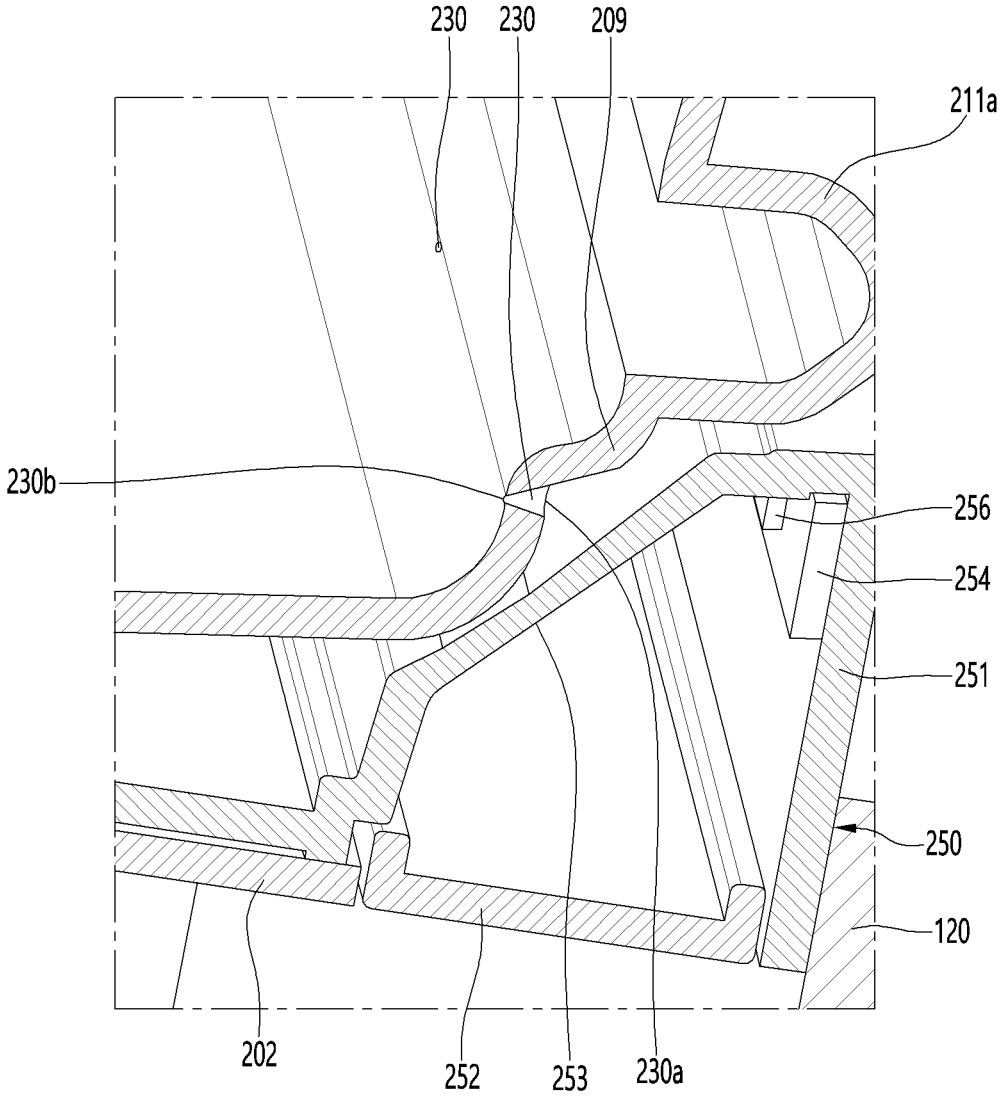
FIG. 12 is a cross-sectional view taken along line 12-12 of FIG. 2.

FIG. 12 is a cross-sectional view taken along line 12-12 of FIG. 2.

Referring to FIG. 12, the lighting unit 250 may be installed on the door liner 200. For example, the lighting unit 250 may be installed on the inner body 202.

For example, the lighting unit 250 may include a case 251 and a cover 252 that covers the case 251.

The cover 252 may extend lengthily in the left and right direction along the door liner 200 and may be installed on the inner body 202. A portion of the cover 252 may be in contact with the first insulating panel 120. That is, in the state in which the cover 252 is installed on the inner body 202, the cover 252 and a portion of the inner body 202 may be in contact with the first insulating panel 120.

The case 251 defines a space for accommodating a light emitting unit PCB 254 in which a plurality of light emitting units 256 are installed.

The case 251 includes a reflective surface 253 on which a surface facing the light emitting unit PCB 254 is rounded or inclined. The light irradiated from the light emitting unit 256 is reflected by the reflective surface 253 and is directed to the cover 252.

The cover 252 may be provided to be transparent or translucent so that the light reflected from the reflective surface 253 and then spread may be transmitted.

For example, the light emitting unit 256 irradiates light in a direction away from the first insulating panel 120, and the irradiated light is reflected from the reflective surface 253 to passes through the cover 252 and then is transmitted toward a liner opening 201 of the door liner 200.

Figure 13:
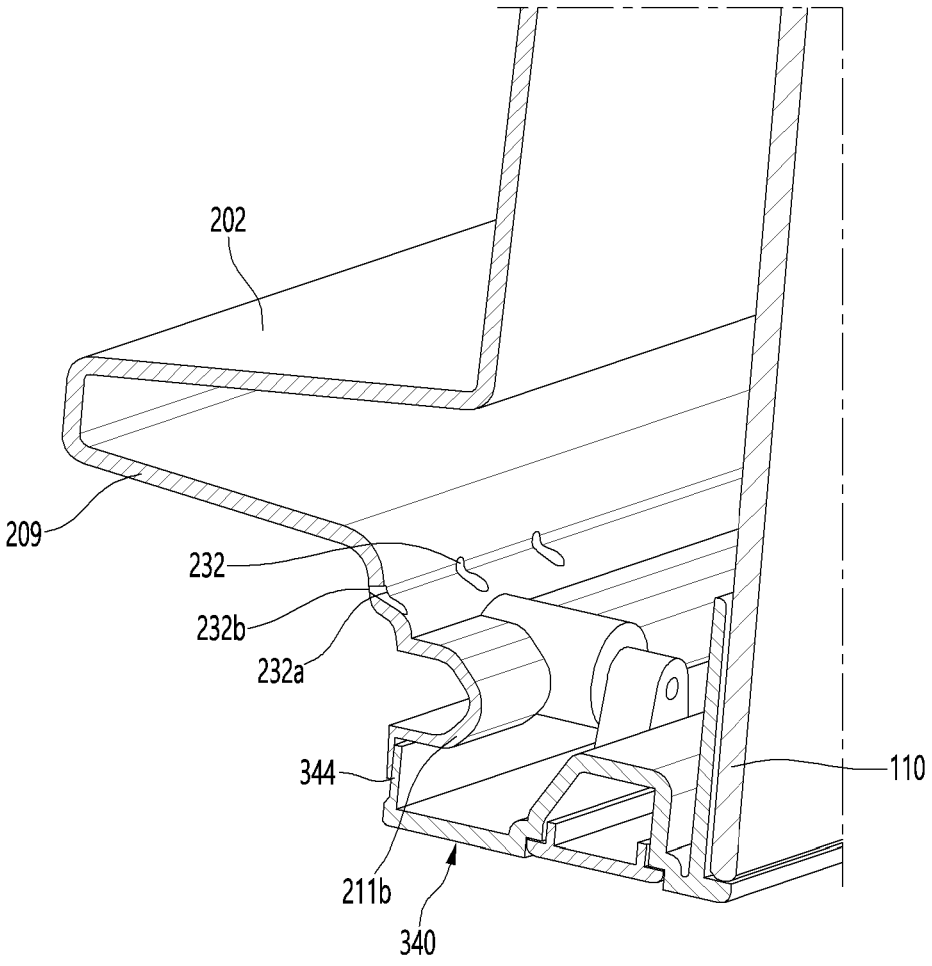
FIG. 13 is a cross-sectional view taken along line 13-13 of FIG. 2.

FIG. 13 is a cross-sectional view taken along line 13-13 of FIG. 2.

Referring to FIGS. 9, 12 and 13, the door liner 200 may include air holes 230 and 232 through which air present in the insulating space 410 is discharged when the foaming liquid is injected into the insulating space 410.

The air holes 230 and 232 may include a first air hole 230 for discharging the air of the fourth space 414 to the outside. For example, a plurality of first air holes 230 may be defined to be spaced apart in the horizontal direction.

The gasket coupling portion 211 may extend along a circumference of the door liner 200, and a portion of the gasket coupling portion 211 may be disposed higher than the lighting unit 250. A portion of the gasket coupling portion 211 disposed higher than the lighting unit 250 may be referred to as a first coupling portion 211*a*.

The first air hole 230 may be disposed lower than the first coupling portion 211*a* at a position close to the first coupling portion 211*a*. That is, the first air hole 230 may be disposed radially inside the gasket coupling portion 211. In another aspect, the first air hole 230 may be disposed inside an area defined by the gasket coupling portion 211.

When the gasket is coupled to the gasket coupling portion 211, the plurality of first air holes 230 may be covered by the gasket. Thus, the plurality of first air holes 230 may be prevented from being exposed to the outside.

The first air hole 230 may have a cross-sectional area that gradually decreases in a direction away from the insulating space 410. Alternatively, the first air hole 230 may include an inlet 230*a* through which the air of the insulating space 410 is introduced and an outlet 230*b* through which the air is discharged to the outside. Here, the inlet 230*a* may have a size less than that of the outlet 230*b*.

In this case, while the air may be introduced through the inlet 230*a*, the foaming liquid may be prevented from being introduced.

The air holes 230 and 232 may include a second air hole 232 for discharging the air of the third space 413 to the outside. For example, a plurality of second air holes 232 may be disposed to be spaced apart in the horizontal direction.

The other portion of the gasket coupling portion 211 may be disposed adjacent to the lower frame 340. The other portion of the gasket coupling portion 211 disposed adjacent to the lower frame 340 may be referred to as a second coupling portion 211*b*.

The second air hole 232 may be disposed higher than the second coupling portion 211*b* at a position close to the second coupling portion 211*b*. That is, the second air hole 232 may be disposed radially inside the gasket coupling portion 211. In another aspect, the second air hole 232 may be disposed inside an area defined by the gasket coupling portion 211.

When the gasket is coupled to the gasket coupling portion 211, the plurality of second air holes 232 may be covered by the gasket. Thus, the plurality of second air holes 232 may be prevented from being exposed to the outside.

The second air hole 232 may have a cross-sectional area that gradually decreases in a direction away from the insulating space 410. Alternatively, the second air hole 232 may include an inlet 232*a* through which the air of the insulating space 410 is introduced and an outlet 232*b* through which the air is discharged to the outside. Here, the inlet 232*a* may have a size less than that of the outlet 232*b*.

In this case, while the air may be introduced through the inlet 232*a*, the foaming liquid may be prevented from being introduced.

Figure 14:
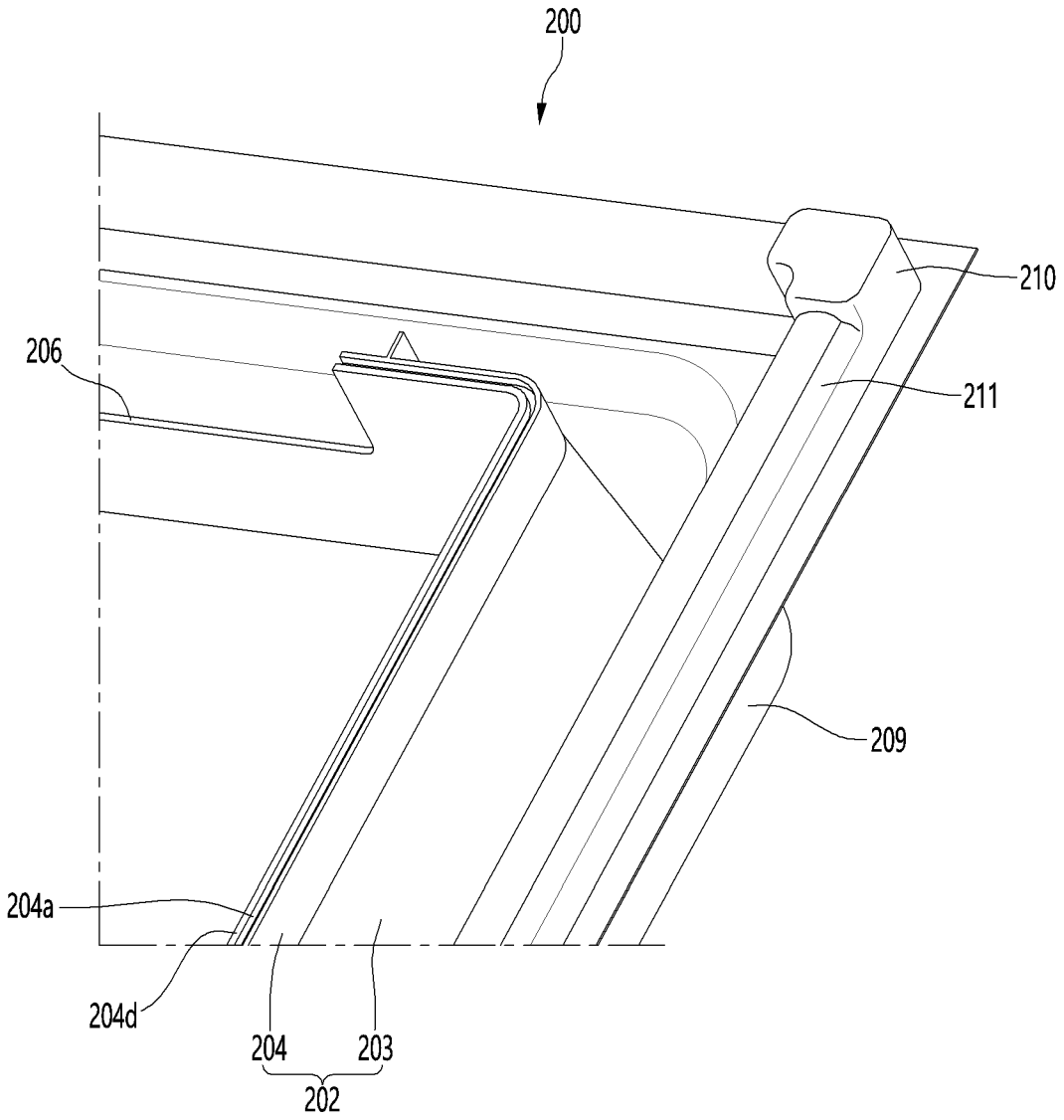
FIG. 14 is a view illustrating an inner body of the door liner according to an embodiment.
Figure 15:
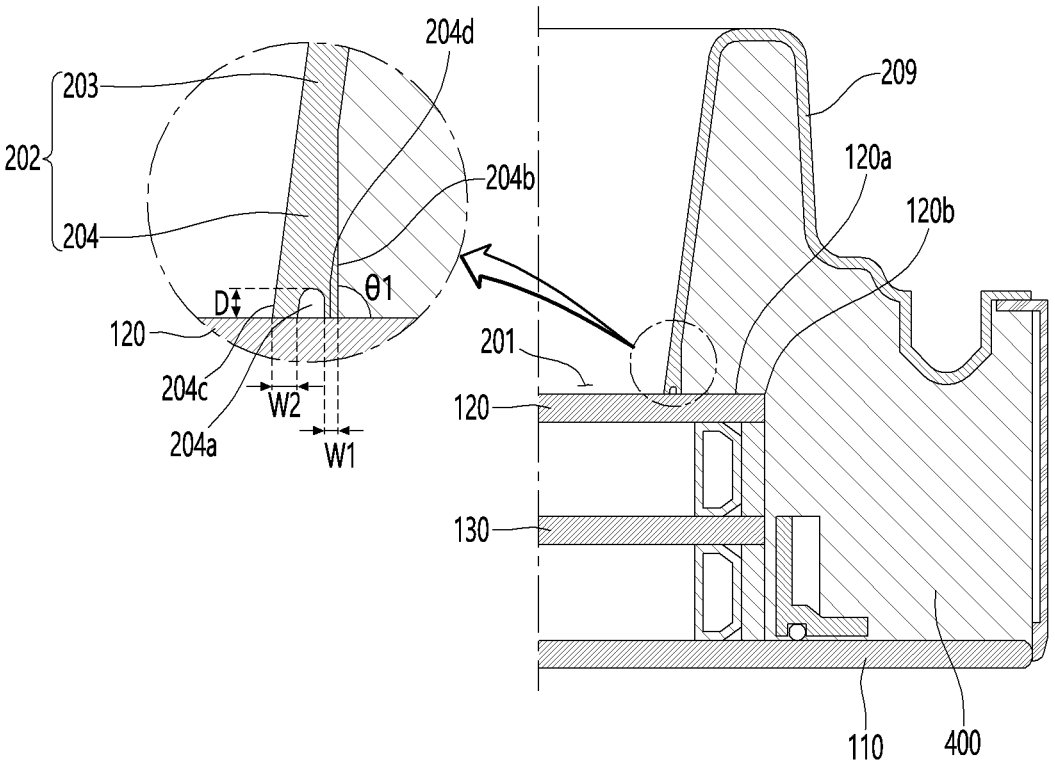
FIG. 15 is a cross-sectional view taken along line 15-15 of FIG. 2.
Figure 16:
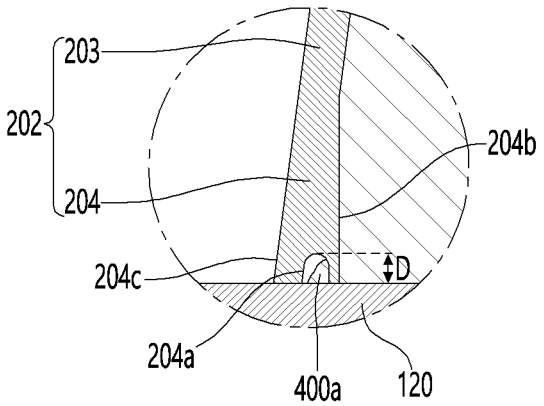
FIG. 16 is a view illustrating a state in which an insulator is disposed in a recessed space of the door liner.

FIG. 14 is a view illustrating an inner body of the door liner according to an embodiment, FIG. 15 is a cross-sectional view taken along line 15-15 of FIG. 2, and FIG. 16 is a view illustrating a state in which the insulator is disposed in a recessed space of the door liner.

Referring to FIGS. 3, 12, and 14 to 16, an inner body 202 of the door liner 200 according to this embodiment includes a first body 203 and a second body 204 extending from a first body 203.

The coupling protrusion 207 may be disposed on the first body 203. An installation opening 206 for installing the lighting unit 250 may be provided on the first body 203 and the second body 204. The installation opening 206 may be defined by being recessed from the second body 204 toward the first body 203.

The second body 204 may be in contact with the rear surface 120*a* of the first insulating panel 120. Here, in the state in which the lighting unit 250 is disposed in the installation opening 206, the lighting unit 250 may be in contact with the rear surface 120*a* of the first insulating panel 120.

The second body 204 may have a thickness greater than that of the first body 203.

The second body 204 may increase in thickness as a distance from the first body 203 increases. Alternatively, a portion of the second body 204, which is connected to the first body 203, may have a thickness greater than that of a portion of the second body 204, which is in contact with the first insulating panel 120.

For example, the second body 204 may include an inner surface 204*b* defining the insulating space 410 and an outer surface 204*c* facing the inner surface 204*b*.

The outer surface 204*c* may define the liner opening 201. The inner surface 204*b* may be in contact with the insulator 400 in the insulating space 410.

A distance between the outer surface 204*c* and the inner surface 204*b* may increase as approaching the first insulating panel 120. Alternatively, a distance between the outer surface 204*c* and the inner surface 204*b* at the portion of the second body 204, which is connected to the first body 203, may be greater than that between the outer surface 204*c* and the inner surface 204*b* at the portion of the second body 204, which is in contact with the first insulating panel 120.

The outer surface 204*c* may be continued from the first body 203 to define a straight line.

When the first storage area door 21 is opened, the user may see the outer surface 204*c* from the inner body 202. Since the outer surface 204*c* of the second body 204 defines a continuous surface with the first body 203, there is no height difference on the inner body 202, and thus, the inner body 202 is simple and elegant.

Also, since the outer surface 204*c* of the second body 204 defines the continuous surface with the first body 203, a size of the second portion 112 in the front panel 110 may be reduced. As a result, the size of the first portion 111 serving as the transmission portion may increase.

On the other hand, the outer surface 204*c* is continued from the first body 203, but may extend to be inclined at a predetermined angle from the first body 203.

The second body 204 may include a contact surface 204*d* that is in contact with the rear surface 120*a* of the first insulating panel 120.

The contact surface 204*d* may be in contact with the rear surface 120*a* of the first insulating panel 120 at a position spaced a predetermined distance inward from an edge 120*b* of the first insulating panel 120.

The contact surface 204*d* may be disposed to face the second portion 112 of the front panel 110.

An angle θ1 defined between the inner surface 204*b* and the rear surface 120*a* of the first insulating panel 120 in the state in which the contact surface 204*d* is in contact with the rear surface 120*a* of the first insulating panel 120 may be less than about 90 degrees. Thus, the angle between the inner surface 204*b* and the contact surface 204*d* may be an obtuse angle.

An angle between the contact surface 204*d* and the outer surface 204*c* may be an acute angle.

The angle between the contact surface 204*d* and the inner surface 204*b* may be greater than that between the contact surface 204*d* and the outer surface 204*c*.

A recessed space 204*a* may be defined in the contact surface 204*d*. The recessed space 204*a* may be recessed from the contact surface 204*d* in a direction away from the first insulating panel 120. Alternatively, the recessed space 204*a* may be recessed from the contact surface 204*d* toward the first body 203.

The recessed space 204*a* may be continued along the contact surface 204*d* in the inner body 202.

Even if a portion of the foaming liquid injected into the heat insulation space 410 leaks through between the contact surface 204*d* and the rear surface 120*a* of the first insulating panel 120, the leaking foaming liquid may be accommodated in the recessed space 204*a*.

Since a gap between the contact surface 204*d* and the rear surface 120*a* of the first insulating panel 120 is very small, and a temperature of the foaming liquid is rapidly lowered while the foaming liquid passes through the gap, the foaming liquid is hardened in the recessed space 204*a* while moving into the recessed space 204*a*.

As illustrated in FIG. 15, when the foaming liquid leaking into the recessed space 204*a* is hardened, and a portion 400*a* of the insulator 400 is disposed in the recessed space 204*a*, the insulator disposed in the recessed space 204*a* serves as a barrier that prevents the foaming solution from additionally leaking.

That is, the portion 400*a* of the insulator 400 disposed in the recessed space 204*a* may prevent the foaming liquid from leaking between the contact surface 204*d* and the rear surface 120*a* of the first thermal insulating panel 120.

In this embodiment, even if the foaming liquid leaks into the recessed space 204*a*, the foaming liquid may be prevented from leaking from the recessed space 204*a* to the outer surface 204*c* by the rapid curing of the foaming liquid.

Also, when the foaming liquid leaking into the recessed space 204*a* is hardened, the hardened foaming liquid serves to connect the second body 204 to the rear surface 120*a* of the first insulating panel 120. Thus, after the foaming is completed, coupling force between the door liner 200 and the first insulating panel 120 may increase.

The recessed space 204*a* may be disposed closer to the inner surface 204*b* than the outer surface 204*c*. In the second body 204, a width W1 of a portion between the recessed space 204*a* and the inner surface 204*b* is greater than a width W2 of a portion between the recessed space 204*a* and the outer surface 204*c*. A distance between the recessed space 204*a* and the inner surface 204*b* may be less than a distance between the recessed space 204*a* and the outer surface 204*c*.

When the recessed space 204*a* is closer to the inner surface 204*b* than the outer surface 204*c*, the foaming liquid leaking from the inner surface 204*b* toward the depressed space 204*a* may quickly move to the recessed space 204*a* and then hardened. Thus, when the recessed space 204*a* is disposed away from the outer surface 204*c*, the foaming liquid of the recessed space 204*a* may be effectively prevented from leaking toward the outer surface 204*c*.

A minimum thickness of the second body 204 may be greater than a depth D of the recessed space 204*a*.

A maximum width of the recessed space 204*a* may be less than a minimum distance between the recessed space 204*a* and the outer surface 204*c*.

The depth D of the recessed space 204*a* may be greater than a maximum width of the recessed space 204*a*. Thus, the foaming liquid leaking into the recessed space 204*a* may be prevented from leaking to the outside before being hardened in the recessed space 204*a*.

According to this embodiment, the straightness of the foaming liquid is maintained in the insulating space, and thus the foaming liquid may be uniformly distributed inside the refrigerator door.

Also, it may be prevented that the injection portion from being blocked in the process of injecting the foaming liquid.

Also, in the state in which the injection of the foaming liquid is completed, the space inside the upper frame may be partitioned from the injection portion, and thus, the service of the components inside the upper frame may be easy.

Also, according to this embodiment, the foaming liquid may be prevented from leaking in the state in which injection of the foaming liquid is completed.

When the foaming liquid moves to the recessed space of the door liner, the foaming liquid may connect the door liner to the insulating panel to increase in coupling force between the door liner and the insulating panel.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet defining a storage space; and a door configured to open and close at least a portion of the storage space, wherein the door comprises:

a panel assembly comprising (i) a front panel and (ii) an insulating panel spaced apart from the front panel, a door frame connected to the panel assembly, a door liner coupled to the door frame, the door liner having a liner opening, and an insulator provided in an insulating space that is defined by the panel assembly, the door frame, and the door liner, wherein the door frame comprises:

an injection portion configured to receive a foaming liquid therethrough to provide the insulator to the insulating space, a front wall facing the front panel, a rear wall spaced apart from the front wall, and a connection wall connecting an end portion of the front wall to an end portion of the rear wall, the connection wall including an inclined portion that is inclined with respect to the front wall, wherein the connection wall, the front wall, and the rear wall define an accommodation space that is partitioned from the insulating space, and wherein the injection portion comprises:

a first portion that protrudes from the connection wall and is configured to guide the foaming liquid from an outside of the insulating space into the insulating space, and a second portion defined at the inclined portion of the connection wall and configured to guide the foaming liquid within the insulating space.

2. The refrigerator of claim 1, wherein the first portion of the injection portion defines a guide tube configured to guide the foaming liquid to pass through the door frame, and wherein the second portion of the injection portion defines a guide groove configured to guide the foaming liquid from the guide tube.

3. The refrigerator of claim 2, wherein the guide tube is configured to guide the foaming liquid to the insulating space in a first direction, and wherein the guide groove is configured to guide at least a portion of the foaming liquid within the insulating space in the first direction.

4. The refrigerator of claim 2, wherein the door frame defines an opening, wherein the door further comprises a frame cover that is coupled to the door frame and covers the opening of the door frame, and wherein the frame cover is configured to, based on the frame cover being coupled to the door frame, cover the guide tube.

5. The refrigerator of claim 2, wherein a horizontal cross-section of the guide tube has a circular shape, and a horizontal cross-section of the guide groove has a semicircular shape or an arc shape.

6. The refrigerator of claim 2, wherein the guide tube extends in a direction away from the insulating panel and is disposed in the accommodation space.

7. The refrigerator of claim 6, wherein the insulating panel is disposed closer to the guide groove than to the front wall.

8. The refrigerator of claim 6, wherein the guide tube is disposed between the front wall and the rear wall, the guide tube being spaced apart from at least one of the front wall or the rear wall.

9. The refrigerator of claim 6, wherein the inclined portion of the connection wall extends downward toward the rear wall.

10. The refrigerator of claim 6, wherein the connection wall is spaced apart from the front panel, and wherein a portion of the insulator is provided between a rear surface of the front panel and the guide groove after the foaming liquid is injected into the insulating space.

11. The refrigerator of claim 6, wherein the connection wall comprises:

a first surface defining the accommodation space; and a second surface defining the insulating space, wherein the guide tube extends from the first surface of the connection wall, and wherein the guide groove is recessed from the second surface of the connection wall toward the rear wall.

12. The refrigerator of claim 6, wherein the door liner comprises:

a liner extension portion extending toward the rear wall; and a rib spaced apart from the liner extension portion, and wherein the door frame further comprises a frame extension portion disposed between the rib and the liner extension portion.

13. The refrigerator of claim 12, wherein the door liner further comprises a gasket coupling portion that defines a recess, wherein the door further comprises a gasket coupled to the recess of the gasket coupling portion, and wherein the liner extension portion and the rib extend from the gasket coupling portion.

14. The refrigerator of claim 6, wherein the door liner further comprises an inner body that defines the liner opening, and wherein an end of the inner body is in contact with a rear surface of the insulating panel.

15. The refrigerator of claim 6, further comprising a sensor disposed within the accommodation space.

16. The refrigerator of claim 1, wherein the door frame further comprises a protrusion that is attached to the front panel by an adhesive.

17. The refrigerator of claim 16, wherein the connection wall connects a lower portion of the front wall to a lower portion of the rear wall, and wherein the front wall comprises a plurality of protrusion ribs that are spaced apart from one another in a vertical direction and extend in a horizontal direction.

18. The refrigerator of claim 17, wherein a portion of the insulator is provided between the front panel and the front wall and in contact with the front panel and the front wall.

19. The refrigerator of claim 1, wherein the injection portion is one of a first injection portion and a second injection portion that are disposed at the door frame and spaced apart from each other in a horizontal direction.

20. The refrigerator of claim 19, wherein the door frame further comprises a first side wall and a second side wall spaced apart from the first side wall, wherein the first injection portion is disposed closer to the first side wall than to the second side wall, and the second injection portion is disposed closer to the second side wall than to the first side wall, and wherein a distance between the first injection portion and the first side wall is different from a distance between the second injection portion and the second side wall.

* * * * *